US008353736B2

(12) United States Patent
Wang

(10) Patent No.: US 8,353,736 B2
(45) Date of Patent: Jan. 15, 2013

(54) DOUBLE POINT INDICATING AUTO/MANUAL GAS INFLATOR

(76) Inventor: Hudson Wang, Taiwan (CN)

( * ) Notice: Subject to any disclaimer, the term of this patent is extended or adjusted under 35 U.S.C. 154(b) by 0 days.

(21) Appl. No.: 13/194,943

(22) Filed: Jul. 30, 2011

(65) Prior Publication Data

US 2012/0073466 A1 Mar. 29, 2012

Related U.S. Application Data

(60) Provisional application No. 61/369,441, filed on Jul. 30, 2010.

(51) Int. Cl.
*B63C 9/19* (2006.01)

(52) U.S. Cl. ..... 441/93; 222/5; 102/530

(58) Field of Classification Search ..... 102/530, 102/202.12; 222/5, 23, 51, 3; 141/329, 330; 441/41, 47, 94

See application file for complete search history.

(56) References Cited

U.S. PATENT DOCUMENTS 5,694,986 A * 12/1997 Weinheimer et al. ..... 141/19
6,422,420 B1 * 7/2002 Brown ..... 222/5
6,589,087 B2 * 7/2003 Mackal et al. ..... 441/93

* cited by examiner

*Primary Examiner* — Michelle Clement
*Assistant Examiner* — John D. Cooper
(74) *Attorney, Agent, or Firm* — Daniel S. Polley, P.A.

(57) ABSTRACT

An auto/manual gas inflator incorporating a gas cylinder and an auto cap. A first indication mechanism is provided for indicating the status of the gas cylinder which is visible through a first window in the inflator housing and a second indication mechanism is provided for indicating the status of the auto cap through a second window in the inflator housing. The auto cap in one embodiment uses a dissolvable pill for automatic inflation. A manual activator, such as a lanyard assembly can be used for manual inflation. In either activation method, a pierce pin is moved upward to break the cylinder's seal and release the gas contained within the cylinder.

9 Claims, 20 Drawing Sheets

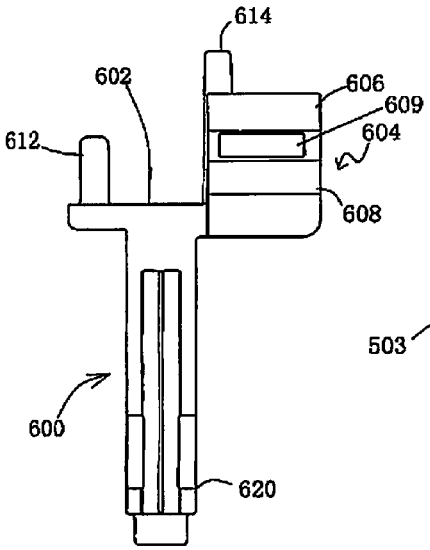
Figure 4a
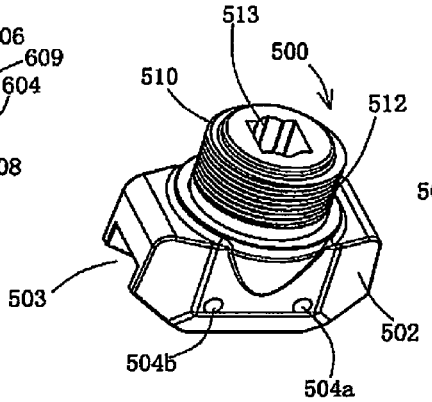
Figure 3a
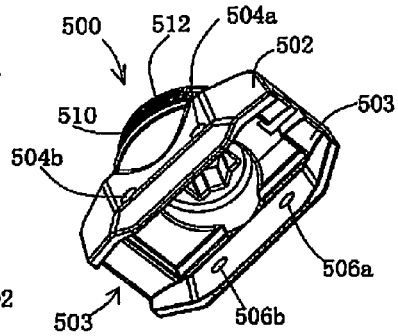
Figure 3b
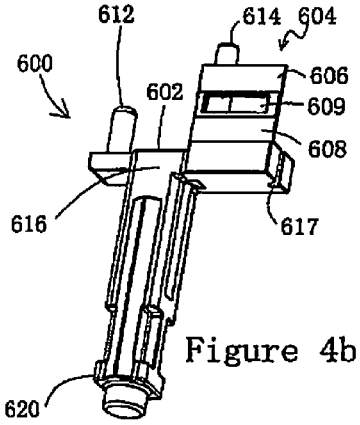
Figure 4b
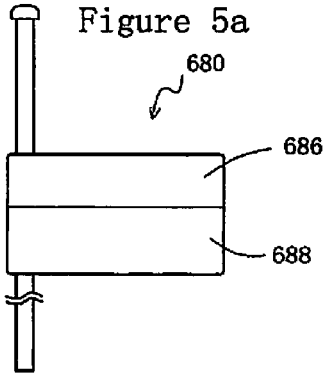
Figure 5a
Figure 5b
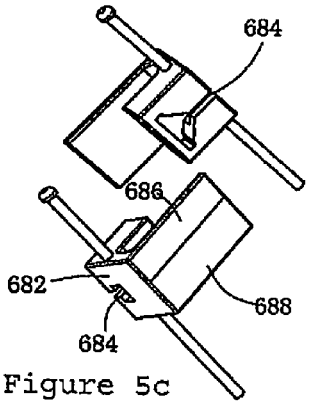
Figure 5c
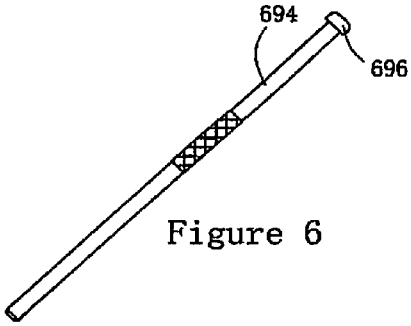
Figure 6
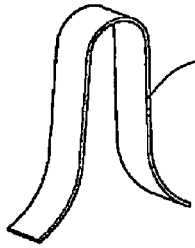
Figure 7

Figure 8a
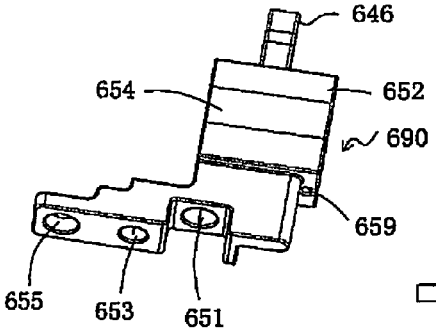
Figure 8b
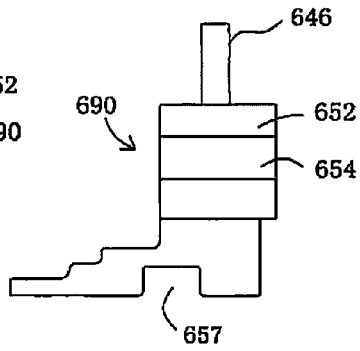
Figure 8c
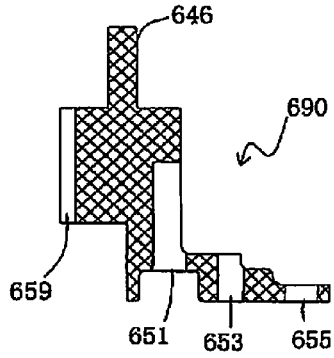
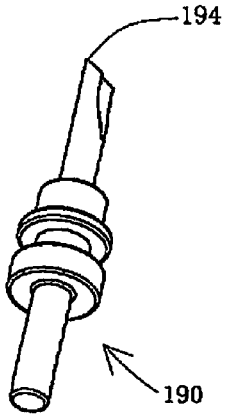
Figure 9a
Figure 9b
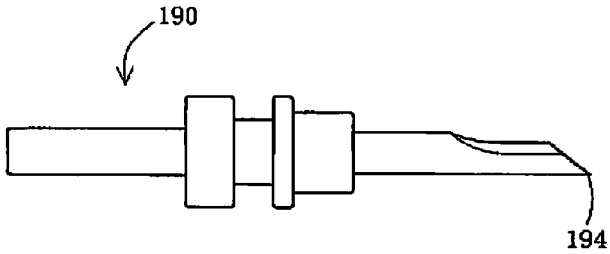
Figure 10b
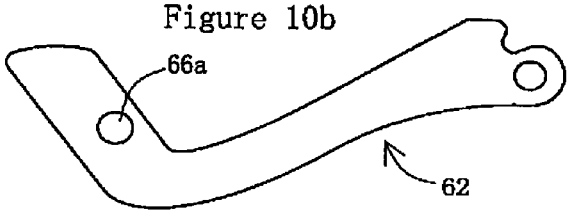
Figure 10a
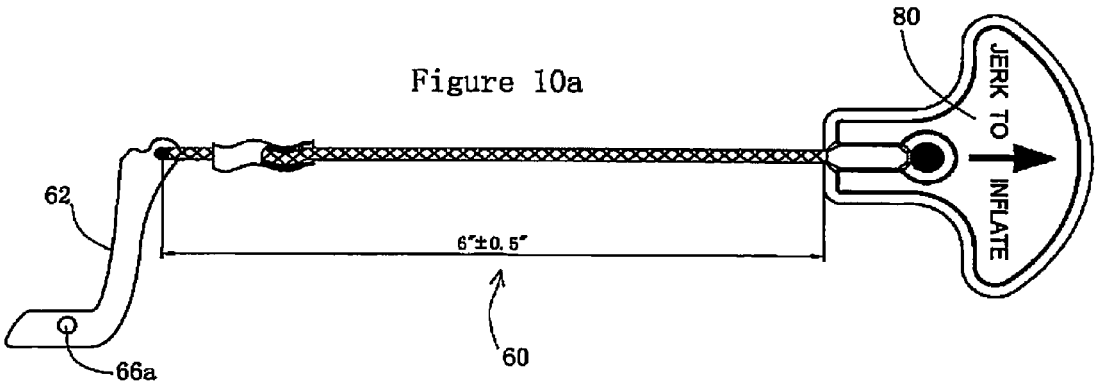

Figure 11a
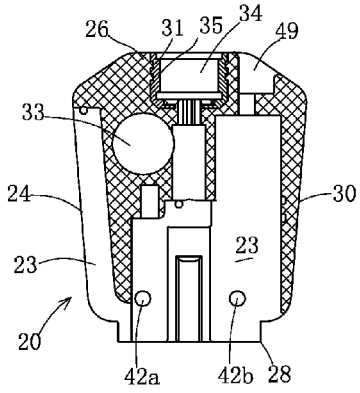
Figure 11b
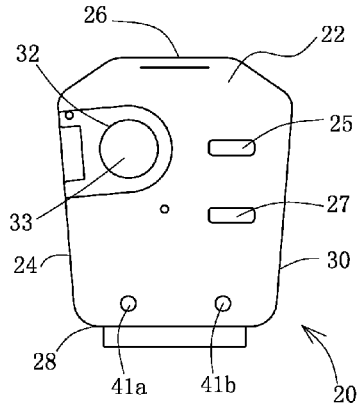
Figure 11c
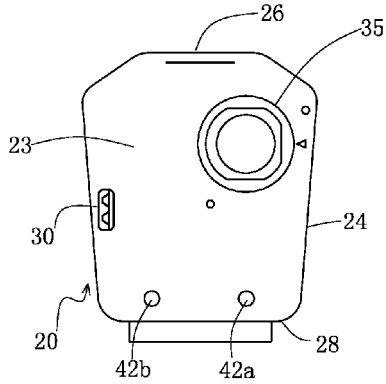
Figure 11d
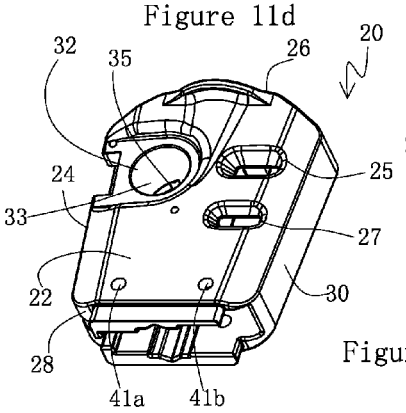
Figure 11e
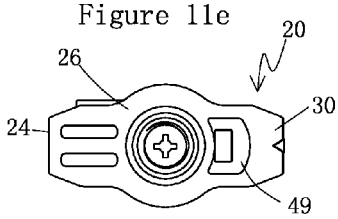
Figure 12
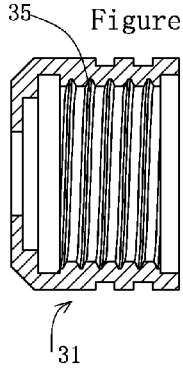
Figure 14
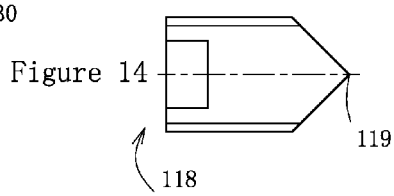
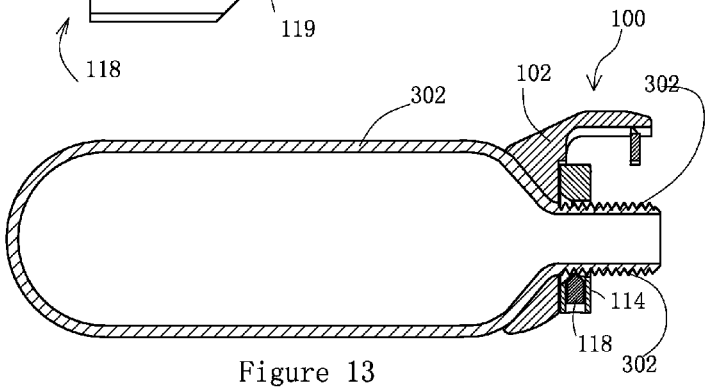
Figure 13
Figure 15a
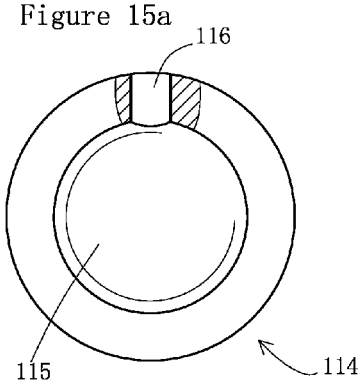
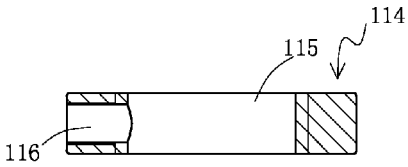
Figure 15b

652 GREEN
654 RED
606 RED
608 RED
688 RED
25
20
27

606 RED
690
691
609
693
608 RED
688 RED

652 GREEN
654 RED
688 RED
25
27

2010-10-01

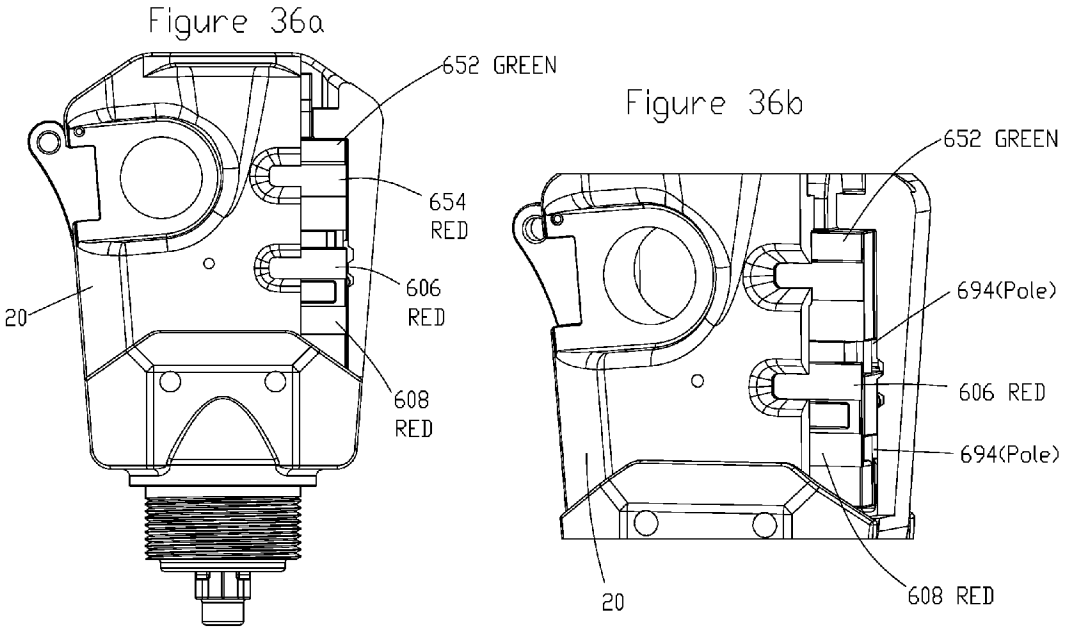
Figure 36a
Figure 36b
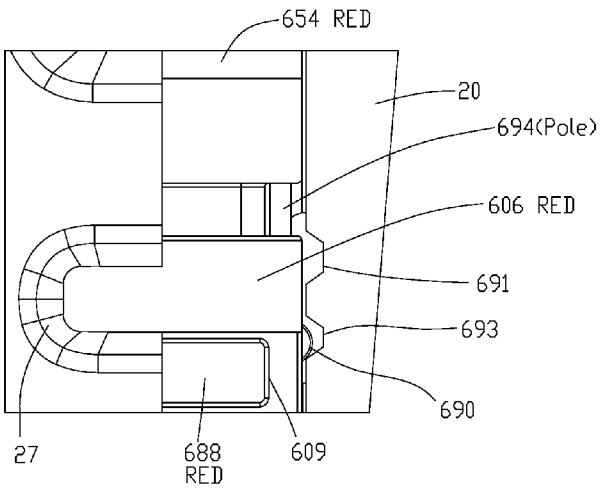
Figure 36c

DOUBLE POINT INDICATING AUTO/MANUAL GAS INFLATOR

BACKGROUND OF THE INVENTION

This application claims the benefit of and priority to U.S. Application Ser. No. 61/369,441, filed Jul. 30, 2010, which application is incorporated by reference in its entirety.

1. Field of the Invention

The present invention relates generally to inflators and particularly to a double point indicating auto/manual gas inflator.

2. Background of the Invention

U.S. Coast Guard regulations require that gas inflators provide a status indicator for the gas cylinder attached to the inflator and which provide information to the user as to whether the inflator device is correctly armed. A Code 2F inflator is an automatic or manually activated inflator. Coast Guard regulations require that the inflator provide status indication for the cylinder seal indication and the readiness of the automatic activation portion of the inflator. When completely rearmed all indicators should simultaneously inform the user of the favorable condition of the inflator. Typically two states are provided for showing the status, either operable or spent. Typically a green color indicates that the cylinder is full and operable or the automatic activation portion is ready and operable. A red color indicates that the cylinder has been spent or that the automatic activation portion is not ready for use. The present invention provides a manual/automatic gas inflator that provides status information for both the cylinder and the automatic activation portion.

SUMMARY OF THE INVENTION

The present invention provides a auto/manual gas inflator incorporating a cartridge status indication mechanism and an auto cap status indication mechanism that can be independent from the cartridge piercing pin. In a preferred embodiment the inflator comprises a body portion, a manual activating assembly, an auto activation assembly, an indicator assembly including an indicator for the cartridge/cylinder and a separate indicator for the auto cap, a pierce pin and associated parts and components.

An arming assembly, which can comprise a carbon dioxide ("CO2") sensor secured to a gas cartridge/cylinder through a nut (with or without a screw) is secured to the inflator body by the mating of threads on the cylinder with internal threads within an internal passageway of the inflator housing/body. When properly connected/assembled a breaking post of the cylinder indicator abuts an internal protrusion of the gas sensor which positions or aligns a first surface area of the cylinder indicator (which can be green in color though not considered limited to the color green) with a first inflator housing window defined by the inflator body so that the first surface area is viewable to indicate that the attached cartridge is full (operable) and ready for use. A separate indicator is provided for the auto cap which is visible through a second inflator housing window to indicate the status of the auto cap.

When it is desired to manually inflate the inflatable item associated with the manifold, the user jerks or pulls a lanyard handle or tab which causes the activation assembly to move the cylinder indicator. The force of this movement causes the cylindrical indicator breaking post to move forward and break or snap the protrusion of the gas sensor and at the same time also moves a pierce pin forward to pierce a diaphragm seal on the cylinder and allow the gas to escape from the cylinder and into the manifold and ultimately to the item associated with the manifold. A second surface area of the indicator (which can be red in color though not considered limited to the color red) is now aligned with and viewable through the inflator body window to indicate that the cartridge has been used (spent, detonated, etc.) and is no longer available for inflation purposes.

If auto activation is desired, upon water entry, the pill disposed within the auto cap dissolved which causes a push pole, member to be contacted causes the push pole to move upward, which in turn causes the cylindrical indicator to again move upward with enough force to break the gas sensor protrusion and allow the pierce pin to pierce the cylinder's diaphragm seal. The push pole is also provided within a portion of the auto cap status indicators and when the auto cap is activated by water/fluid contact, the push pole is move upward such that a red indication is shown in the second inflator window indicating that the auto cap needs to be replaced/reset, etc.

The arming assembly can be removed from its secured attachment to the inflator and a new arming or rearming assembly can be similarly secured to the inflator. Once rearmed, the first color area (i.e. green, etc.) will again be viewable in the inflator body window indicating that the inflator is ready for use.

BRIEF DESCRIPTION OF THE DRAWINGS

FIGS. 3*a* and 3*b* illustrate the base member from two different views;

FIGS. 4*a* and 4*b* illustrate the push pole member from two different views;

FIGS. 5*a* through 5*c* illustrate the auto cap indicator member from three different views;

FIG. 6 is a perspective view of the connecting pin associated with the auto cap indicator member;

FIG. 7 is a perspective view of one embodiment for the spring board or spring leaf which is connected to the auto cap indicator;

FIGS. 8*a* through 8*c* illustrate the cylinder indicator member from three different views;

FIGS. 9*a* and 9*b* illustrate the pierce pin from two different views;

FIG. 10*a* is a side view of a manual activation assembly in accordance with the present invention;

FIG. 10*b* is a side view of the contact arm member of the manual activation assembly;

FIG. 11*a* through FIG. 11*e* illustrate the inflator housing or body from five different views;

FIG. 12 is a side view of a metal insert that can be associated with the inflator housing to provide the internal threads for mating with the cylinder as an alternative to having the internal constructed from an internal passageway wall in the inflator housing;

FIG. 13 is a side sectional view of the cylinder and cylinder securement assembly which is also referred to as a rearming assembly;

FIG. 14 is a side of a screw member of the securement assembly;

FIGS. 15*a* and 15*b* illustrate the nut of the securement assembly from two different views;

FIGS. 24*a* and 24*b* illustrate one non-limiting embodiment for a manifold that the present invention inflator can be secured to;

FIGS. 36*a* through 36*c* illustrate the inflator indicating that both the cylinder and auto cap are missing or have been destroyed.

DETAILED DESCRIPTION OF THE PREFERRED EMBODIMENT

Figure 1A:
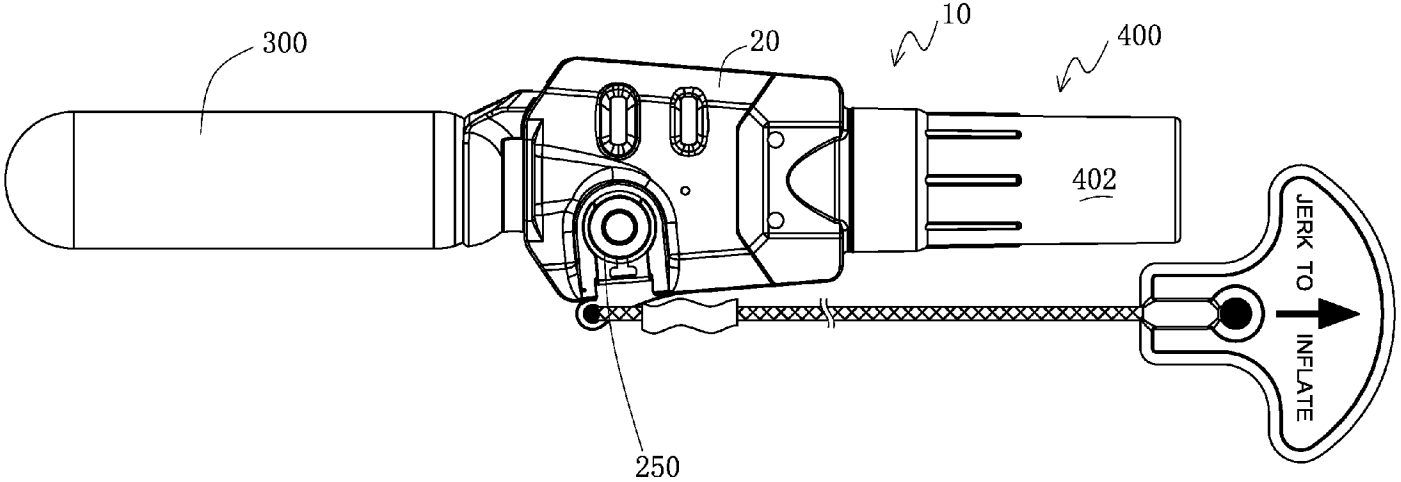
FIG. 1*a* illustrates a side view of the double point indicating auto/manual gas inflator in accordance with the present invention.

As seen in the drawings an inflator having manual and auto inflation capabilities is shown and generally designated as inflator 10. Inflator 10 can be considered a 2f Inflator.

As illustrated in FIG. 1*a* inflator 10 generally comprises an auto inflator body/housing 20, an auto cap assembly 400 having a housing 402 which houses the mechanism for automatic activation or breaking of the seal of gas (i.e. CO2. etc.) cylinder 300 to release the gas. Cylinder 300 can be preferably secured at and to a first end of inflator housing 20 and cartridge 400 can be preferably secured at and to a second end of inflator housing 20 which can be preferably an end opposite to the first end of housing 20.

Figure 1B:
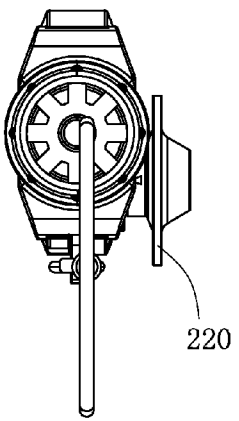
FIG. 1*b* illustrates a different side view of the gas inflator of FIG. 1*a;*
Figure 2:
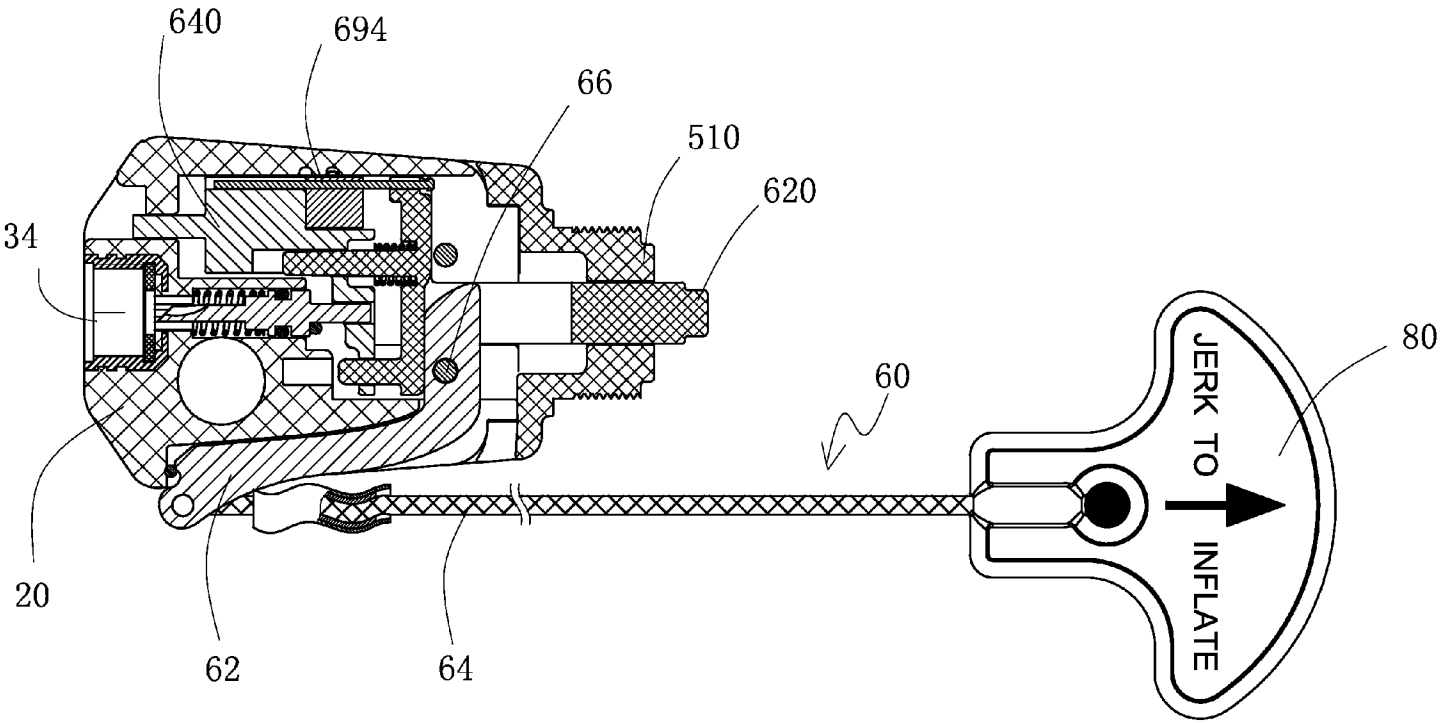
FIG. 2 illustrates a sectional view of the gas inflator of FIG. 1*a* with the cylinder and auto cap removed.
Figure 16A:
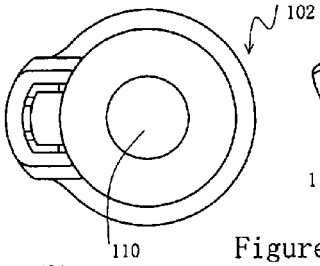
FIGS. 16*a* through 16*d* illustrate the CO2 sensor or blocking member from four different views.
Figure 16B:
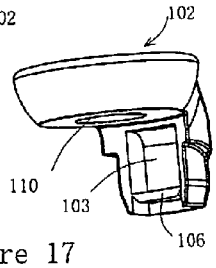
Figure 16C:
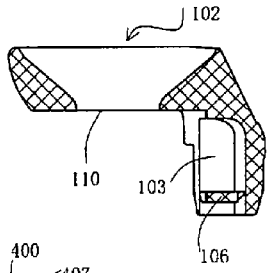
Figure 16D:
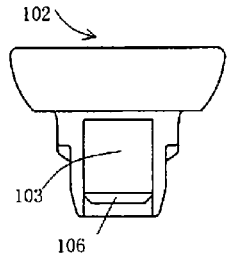
Figure 17:
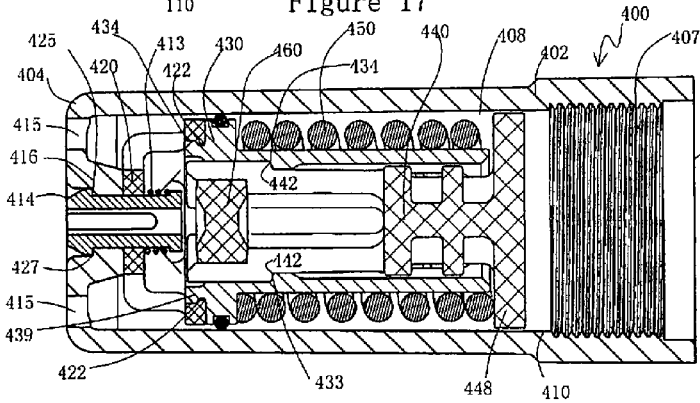
FIG. 17 is a sectional view of auto cap assembly prior to water activation.
Figure 18A:
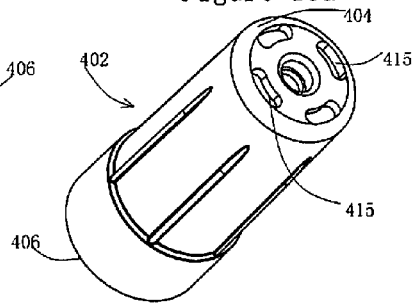
FIGS. 18*a* through 18*c* illustrate the auto cap housing from three different views.
Figure 18B:
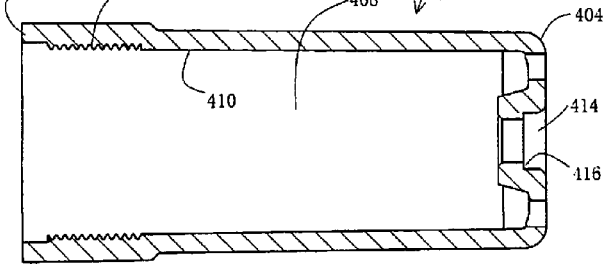
Figure 18C:
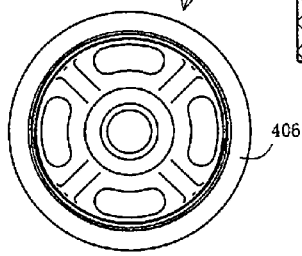
Figure 19A:
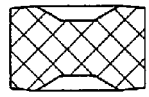
FIGS. 19*a* and 19*b* illustrate one embodiment for the dissolvable pill from two different views.
Figure 19B:
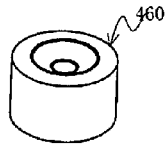
Figure 20A:
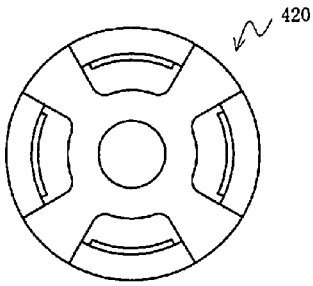
FIGS. 20*a* through 20*d* illustrate the cushion member from four different views.
Figure 20C:
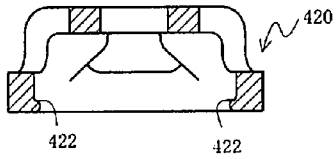
Figure 20D:
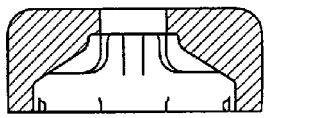
Figure 20B:
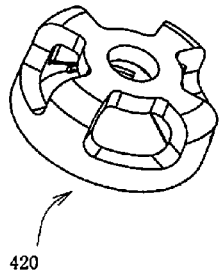
Figure 21A:
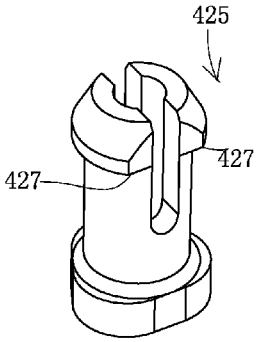
FIGS. 21*a* and 21*b* illustrate the stop block member from two different views.
Figure 21B:
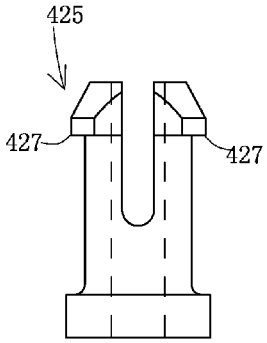
Figure 22A:
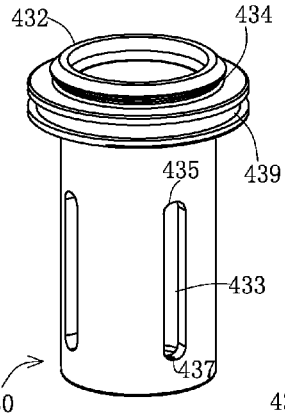
FIGS. 22*a* and 22*b* illustrate the pill holder cover or tube from two different views.
Figure 22B:
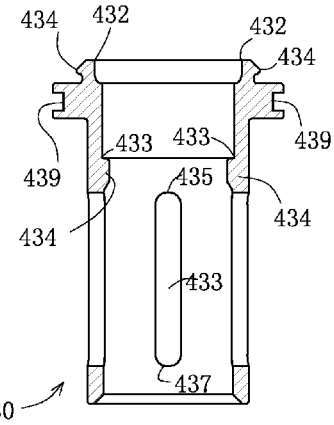
Figure 23A:
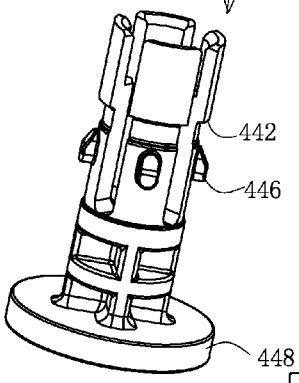
FIGS. 23*a* through 23*c* illustrate the pill holder and push bar member from three different views.
Figure 23B:
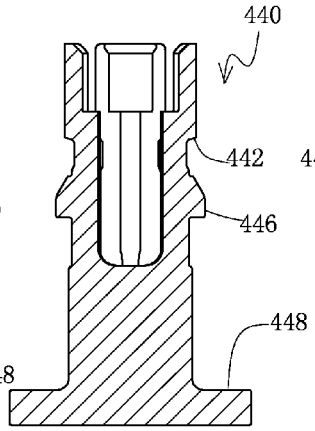
Figure 23C:
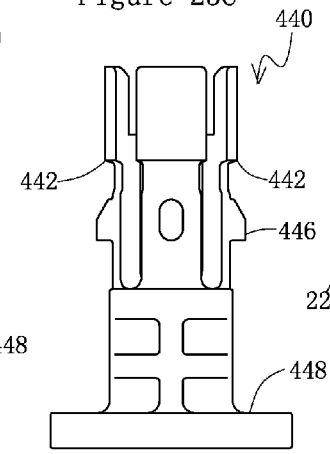
Figure 24A:
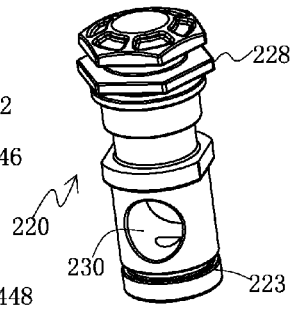
Figure 24B:
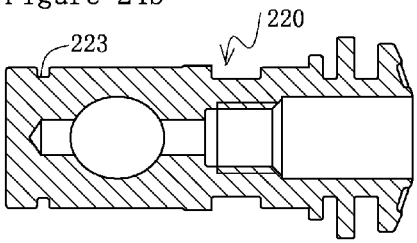
Figure 25:
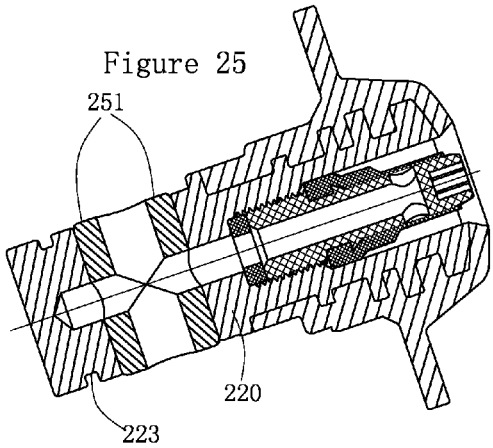
FIG. 25 is a sectional view of the manifold of FIG. 24 shown secured to a mounting flange and containing its internal components.
Figure 26:
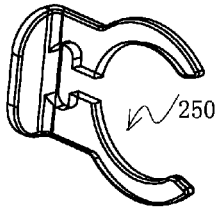
FIG. 26 is a perspective view of the C-clip used for retaining the present invention inflator on a manifold during use.

Inflator 10 can be secured to a manifold, such as manifold 220 (FIG. 1*b*), which can include a "C" clip 250 (See FIG. 1*a*) for helping inflator 10 to stay secured to manifold 220. Manifold 220 will be generally discussed in connection with the operation of inflator 10 and in a first non-limiting embodiment is discussed in more detail in U.S. Published Application Publication No. US 2007/0204909 (Published Sep. 6, 2007—U.S. application Ser. No. 11/460,187, filed Jul. 26, 2006), which is incorporated by reference in its entirety and in a second non-limiting embodiment is shown in FIGS. 24*a*, 24*b*, 25 and 26 which operates similar to the above mentioned first embodiment, but replaces o-rings around the gas inlet with a choke plug 251.

As best seen in FIGS. 11*a*-11*e*, inflator housing/body 20 can includes a front surface 22, back surface 23, first side end 24, top end 26, bottom end 28 and second side end 30. Front surface 22 includes a first window or opening 25 for determining the status of an attached gas cartridge or cylinder, such as, but not limited to, CO2 cylinder or cartridge 300 (as well as if a cylinder 300 is attached), and a second window or opening 27 for determining the status of an auto cap assembly 400 (as well as if an auto cap assembly 400 is attached). The operations of these two status indicators will be discussed in further detail below. Front surface 22 is also provided with opening 41*a* and 41*b* and back surface provided with corresponding aligned openings 42*a* and 42*b*, for receiving a bolt, pin or similar structure (collectively "bolt") for securing base body 502 (FIGS. 3*a* and 3*b*) to housing 20. A first bolt is inserted within opening 41*a* and aligned top and bottom openings 504*a* and 506*a* of base body 502 when attaching or securing base body 500 to housing 20 and can also be inserted through opening 66*a* of contact arm 62 of activating assembly 60 that is also aligned with openings 41*a*, 42*a*, 504*a* and 504*b*, such that contact arm 62 can be pivotally secured to body/housing 20. When securing contact arm 62 to housing 20, contact arm opening 66*a* can be aligned with opening 42*a* and top and bottom openings 504*a* by positioning or inserted portion 66 of contact arm 62 within a slot 503 defined by base body 502 such that the first bolt is inserted within the aligned openings and maintained by any conventional mechanisms, such as, but not limited to a tight/friction fit, screwed in to body 20, etc. Contact arm 62 is also inserted and positioned in connection with the opening/cutout provided at first side end 24 of housing 20. A second bolt is inserted within openings 41*b* and 42*b* (housing 20) and openings 506*a* and 506*b* (base 500).

An opening 32 in front surface 22 represents a first end of a manifold receiving passageway 33. The second end of passageway 33 is represented by an opening 35 in back surface 23 of body 20 and can be provided with a unique configuration, which mates with a unique configuration of a manifold base, such that preferably there is provided only one proper way for inserting the manifold within passageway 33, though such is not considered limiting.

Body 20 can be cutout hollow or opened at bottom end 28 for receipt of base 500 and for providing internal access for positioning the internal components of inflator 10 that are housed within housing 20 such as cylinder indicator 640, pierce pin 190, push pole member 610, and auto cap indicator 670 and their associated components or parts. Bottom end 28 is preferably received within a top slot 503 of base 500 to align the above described openings 42*a* of housing 20 and base 500.

FIG. 11*a* illustrates the internal area of body/housing 20 and show where solid portions exist to create various passageways, openings, etc. Top end 26 includes a passageway 34 which can be provided with internal threads or can receive a metal insert 31 containing internal threads 35 (FIG. 12). The internal threads are provided for mating with threads 302 of CO2 cartridge 300. Passageway 34 is in communication with passageway 33. Top end 26 also includes aperture 41 for receipt of a lower portion 103 of CO2 sensor body 102.

As best seen in FIGS. 13 through 16*d*, the cylinder assembly is shown which can comprise cylinder 300, a CO2 sensor body 102 ("blocking member"), a nut 114 and a screw 118, which collectively can also be referred to as a rearming assembly, when replacing a spent or used cylinder. Sensor body 102 includes an internal hollow area 103 having an internal protrusion 106 extending into hollow area 103. The purpose of protrusion 106 will be discussed in detail below in conjunction with cylinder indicator of push pole assembly 600. Sensor body 102 also includes an opening 110 for receipt of threaded portion 302 of cartridge 300. A nut 114 and screw 118 can also be provided. Nut 114 is used to secure sensor body 102 to cylinder 300, while allow sensor body 102 to freely rotate or spin in place around cylinder 300. When inserted within nut 114, as described below, screw 118 prevents cylinder 300 from moving or rotating with respect to nut 114, in view of point 119 of screw 118 contacting a portion of cylinder threads 302 (See FIG. 13). Secured sensor 100 to cartridge 300 by nut 114, with or without screw 118 and/or nut 114, can be defined as an arming assembly and as a rearming assembly when replacing a spent or detonated cylinder 300 on inflator 10.

To secure the arming/reaming assembly to inflator 10, a portion of sensor body 102 can be positioned within opening 49 in body 20 and threaded end 302 of cylinder 300 is secured to passageway 34 mating the threads of end 302 with internal threads 35 in passageway 34. As sensor body 102 freely rotates in place with respect to cylinder 300, cylinder 300 is permitted to be turn such that threaded end 302 rides the internal threads of passageway 34. Once threaded end has properly mated with the internal threads of passageway 34, the sealed threaded end (such as, but not limited to, through a diaphragm seal or other sealing mechanism, etc.) is positioned proximate to a pierced end 194 of a pierce pin 190 disposed within housing 20 and protrusion 106 contacts or abuts breaking post 646 of cylinder indicator 640, which also positions first color area 652 on a front surface of cylinder indicator 640 to be viewable through window 25 of housing 20 to indicate that cartridge or cylinder 300 is "OK", "Ready", etc. for use. Though not considered limiting, first color area 652 can be colored green.

The assembled inflator 10 is positioned on manifold 220 such that opening 230 of manifold 220 is communication with body passageway 34 to provide a sealed communication between opening 230 and passageway 34. The shape of the post 226 at 228 can be configured to correspond with opening/second end 35 of body passageway 34 such that preferably there is only one way to match the shape of base 228 with opening 35 of passageway 33. This helps to ensure that manifold 220 is properly positioned with respect to inflator 10, namely, that body passageway 34 is positioned and aligned with opening 230. Once inflator 10 is properly attached to manifold 220, clip 250 can be disposed within an external groove 223 on manifold 220 (which can be provided with a metal tube or insert) to act as a stop member and help prevent inflator 10 from being accidentally disconnected from manifold 220.

Figure 27A:
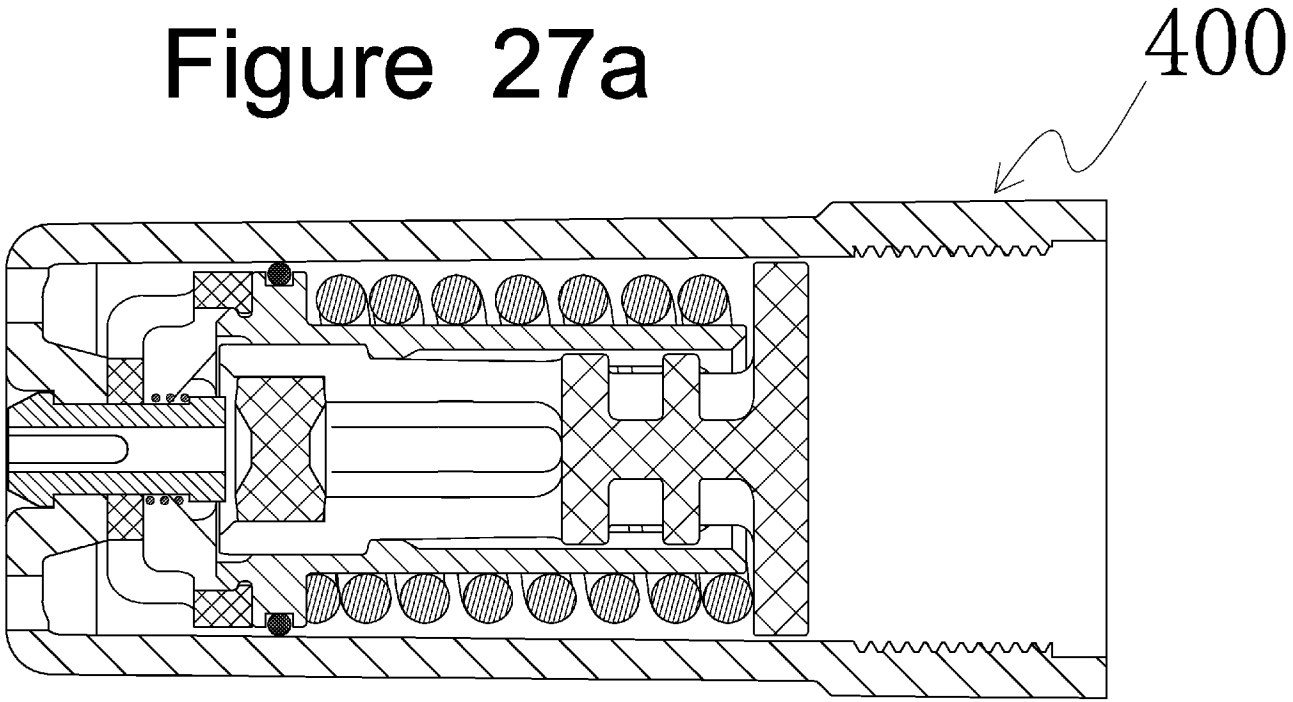
FIGS. 27*a* and 27*b* are sectional views illustrating the auto cap assembly prior to and after water activation, respectively.
Figure 27B:
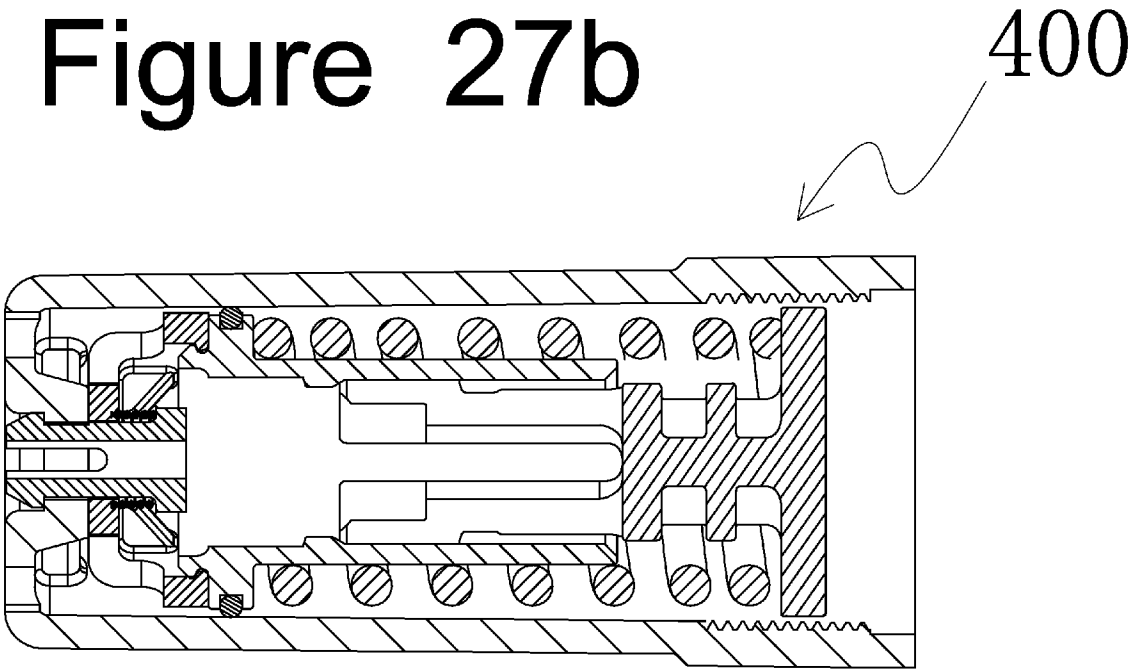
Figure 28:
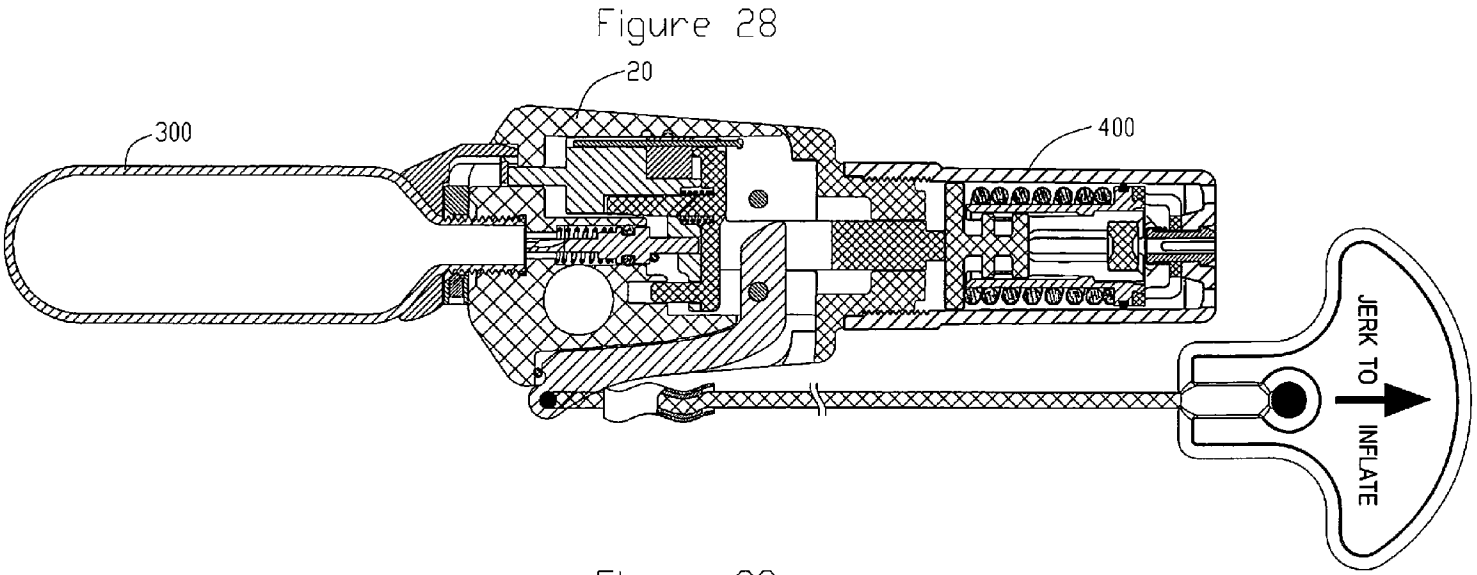
FIG. 28 is a sectional view of the inflator of FIG. 1*a* with the cylinder and auto cap in a "ready for use" status.
Figure 29:
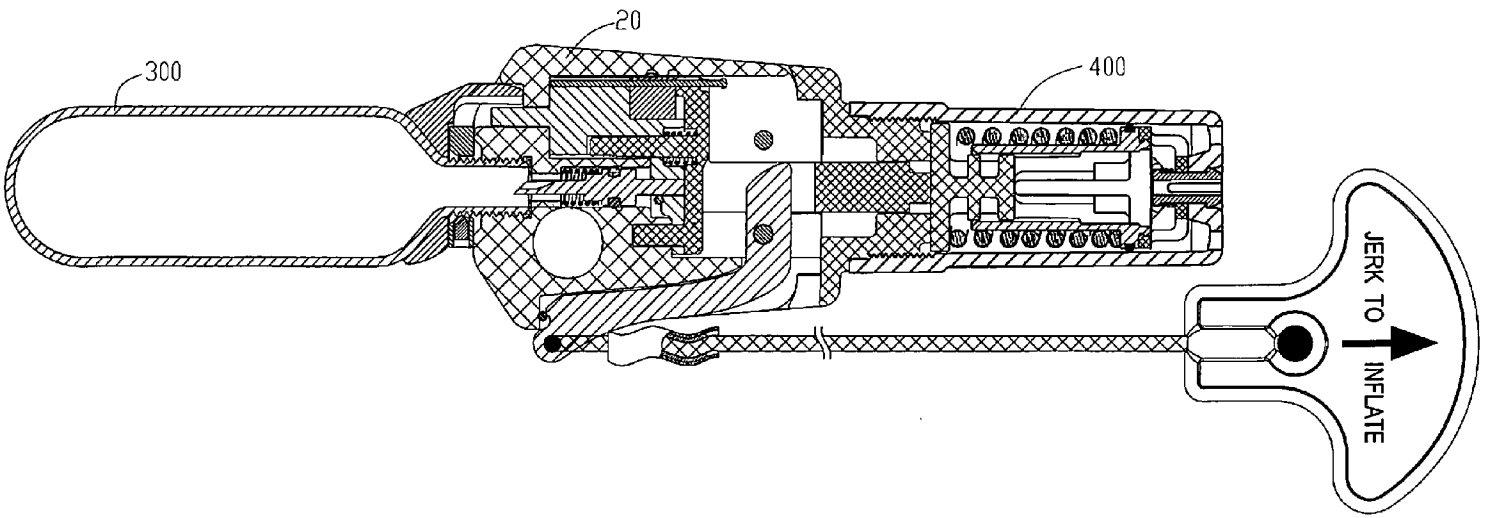
FIG. 29 is a sectional view of the inflator of FIG. 1*a* after automatic activation by the auto cap assembly.
Figure 30:
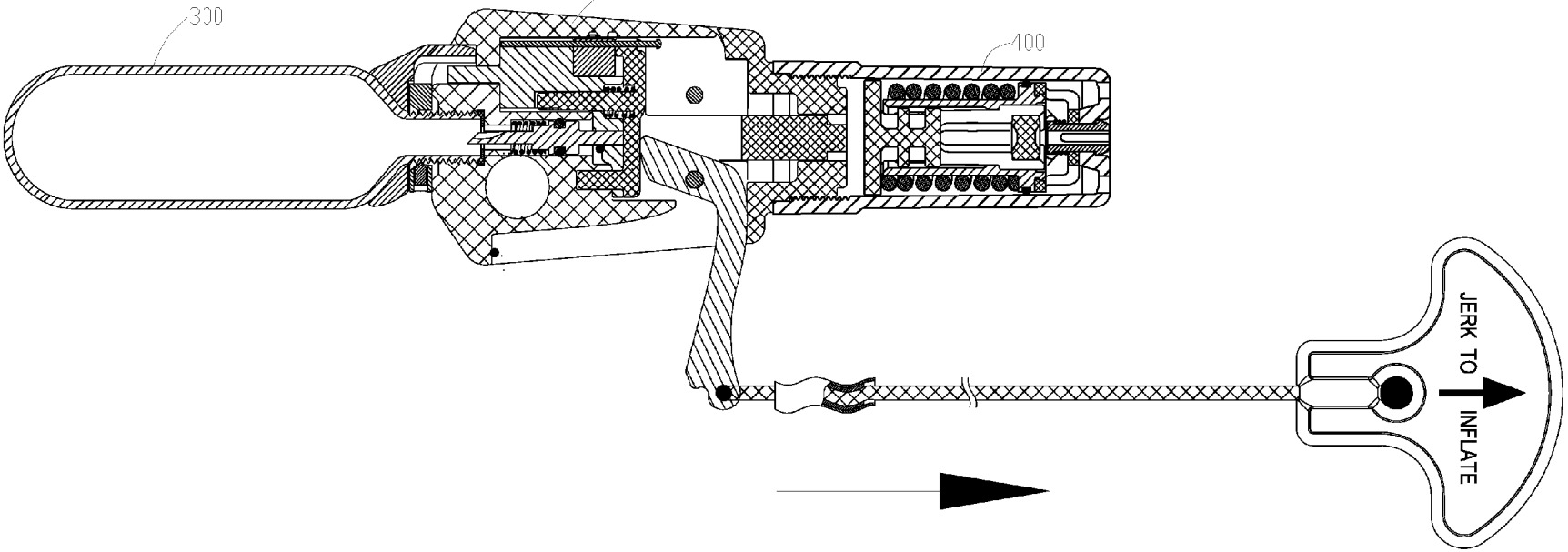
FIG. 30 is a sectional view of the inflator of FIG. 1*a* after manual activation by pulling on the manual activation assembly.

FIGS. 17 through 23*c* illustrate the parts that preferably comprise cartridge 400 which will also be referred to as the auto cap, while FIGS. 27*a* and 27*b* illustrate the assembly and position of the auto cap parts before and after water activation. Cartridge 400 includes a housing 402, which in one embodiment can be an elongated and substantial cylindrical in shape, though such is not considered limiting. As seen in FIGS. 18*a* through 18*c*, housing 402 includes an outer first end 404 and an opened second end 406 and defines an internal passageway 408 within housing 402 extending from outer first end 404 to opened second end 406. A plurality of internal threads 407 can be disposed within the inner wall 410 of housing 402 at or near opened second end 406 for mating with external threads 512 of a male portion 510 of base body 500 when securing cartridge 400 to base body 500. However, other mating or securing relationships can be used and are also considered within the scope of the invention. An opening 414 having a catch 416 can be provided at or near outer first end 404. One or more additional openings 415 can be provided at outer first end 404 or other locations on housing 402 to permit water access within housing 402 during a water activation event.

Disposed within internal passageway 408 is an internal positioner or cushion 420 (FIGS. 20*a* through 20*d*) which provides a ledge or catch 422 for securing a first end 432 of a pill holder cover or tube 430 (FIGS. 22*a* and 22*b*) by a mating or abutting catch 434 of pill holder cover 430. Alternatively, pill holder cover 430 can be designed to be directly secured and/or positioned within passageway 408 without the need of positioner 420. Positioner or cushion 420 can be secured to housing 402 through a stop block 425 having a catch 427 (See FIGS. 21*a* and 21*b*) which abuts catch 416 in opening 414. A buffer spring 413 can be disposed on stop block 425 for positioning purposes.

Prior to water activation (FIGS. 17 and 27*a*), a pill holder 440 (FIGS. 23*a* through 23*c*) is substantially disposed within pill holder cover 430 and maintained in position by the insertion of fluid dissolvable pill 460 (FIGS. 19*a* and 19*b*) disposed or fitting in pill holder 440, such as, but not limited to at or near a first end of pill holder 440. This insertion of pill 460 causes the corresponding or adjacent portion of pill holder to expand outward which causes a ledge portion 442 of pill holder to abut up against a first end 433 of a first stop member 434 of pill holder cover 430 which maintains or locks pill holder 440 in a retracted position, causing contact portion 448 of pill holder 440 to compress a spring 450 (which can be disposed around the external outerwall of pill holder cover 430) and which maintains spring 450 in such compressed position. In this position, one or more flange portions 446 can be positioned at or near a first end 435 of a corresponding slot 433 within pill holder cover 430 and contact portion 448 can be positioned at or near an outer end of a pill holder cover 430. An o-ring 419 can be provided in an external groove 430 of pill holder cover 430 for sealing purposes.

Upon water entry by a user (i.e. water activation) water enters into cartridge 400, such as, but not limited to, through openings 415 and/or slot 414, and contacts pill 460 which dissolves upon contact with water that flows into auto cap 400. The dissolving of pill 460 causes the corresponding portion of pill holder 440 that was expanded outward to move inward, such that the locking relationship ledge 442 of pill holder 440 and first stop member 434 of pill holder cover 430 terminates, such that pill holder 440 is no longer locked in place with respect to pill holder cover 430. As pill holder 440 is not longer locked, spring 450 is permitted to expand pushes up against contact portion 448 causes contact portion 448 to move (shoot out) within the auto cap until ledge portions 446 reached the opposite end 437 of slot 433 of cover 430 which acts as a stop member to prevent any further outward movement (See FIG. 4*c*). However, at this point, contact portion 448 has contacted a post portion 620 of push pole assembly 610 which had extended out of opening 513 of male member 510 of base 500, causing push pole assembly 610 to move upward, which in turn causes cylinder indicator 640 to move upward, which in turn causes post portion 646 to break protrusion 106 of sensor body 102 (that was previously maintaining cylinder indicator 640 in place, such that a green or other "OK" indication or status, was present in window 25) and which permits piece pin 194 to break the seal of cylinder 300 to release the gas contained within cylinder 300.

Thus, the outward movement of contact portion 448 allows it to contact a post portion 620 of a push pole 600, which in turn moves an cylinder indicator 640 within inflator body 20 and pierce pin 190 secured to or associated with cylinder indicator. Thus, upon dissolving of pill 460, this action ultimately moves pierce pin 190 forward to pierce the seal of an attached cylinder 300 to release the gas (CO2) contained within cylinder 300. With the breaking of protrusion 106 and upward movement of cylinder indicator 640 the second color area 654 becomes present in window 25 of housing 20, which represents that cylinder 300 is not ready for use. In one non-limiting embodiment, second color area can be colored red.

Figures 35A, 35B, 35C:
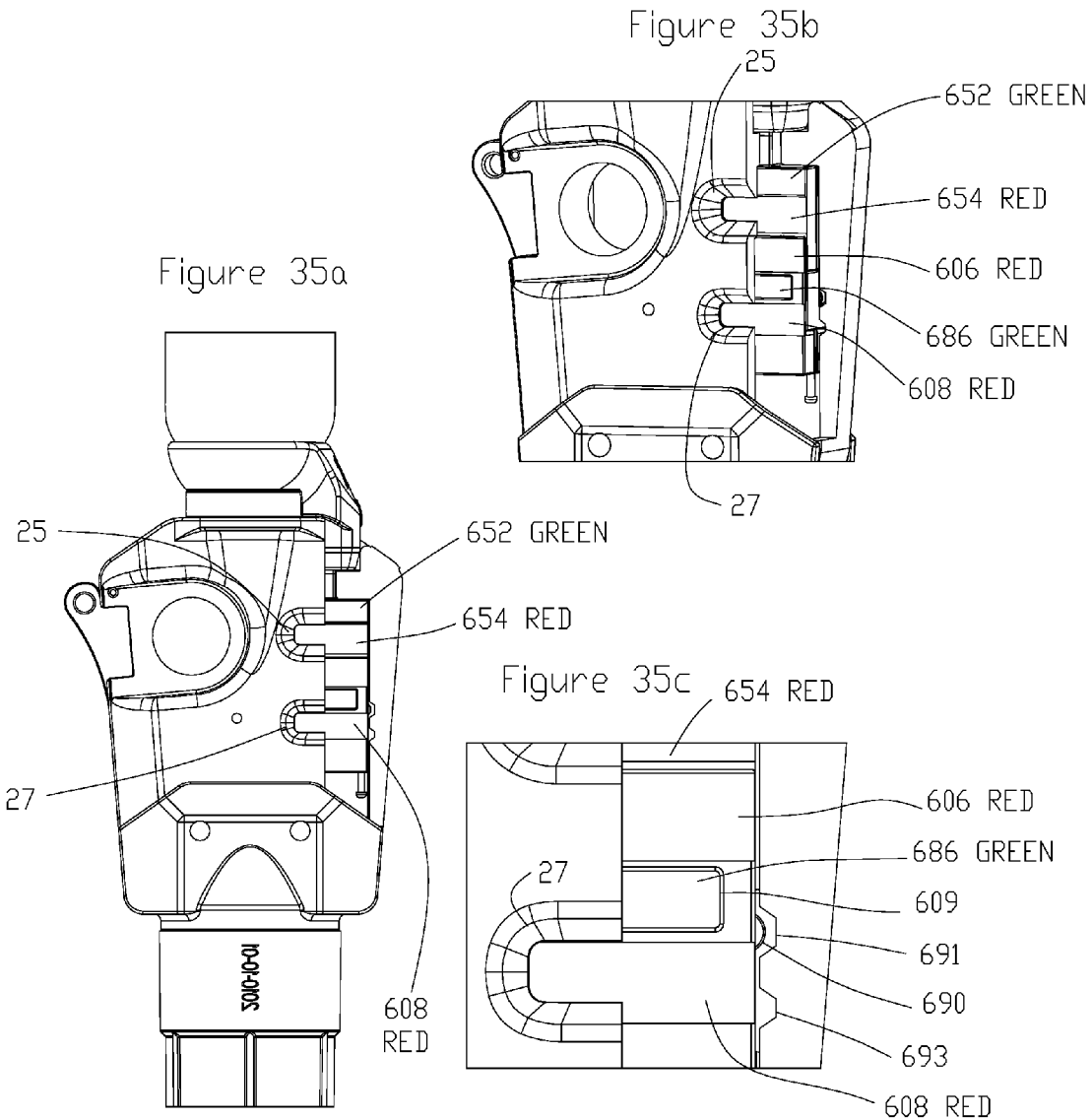
FIGS. 35*a* through 35*c* illustrate the inflator indicating that both the cylinder and auto cap have been used, such as during a water activation event.
Figure 37:
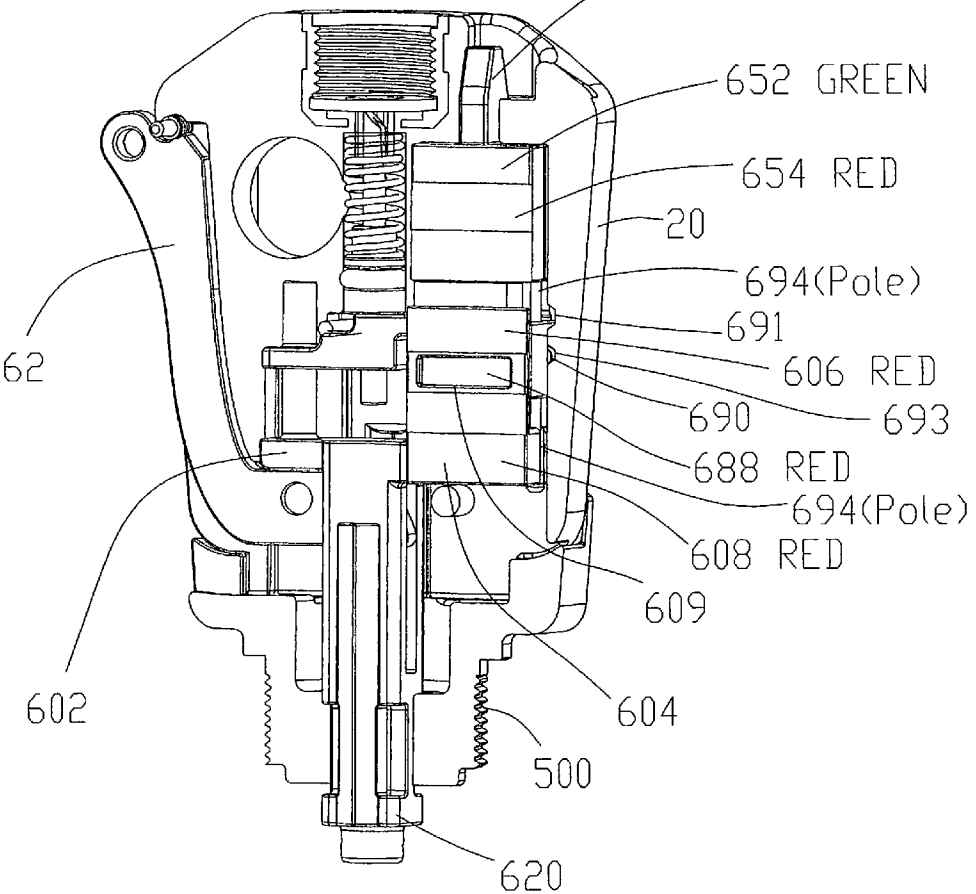
FIGS. 37 through 39 illustrate several view of how the indication members of the present invention interact with each other.
Figure 38:
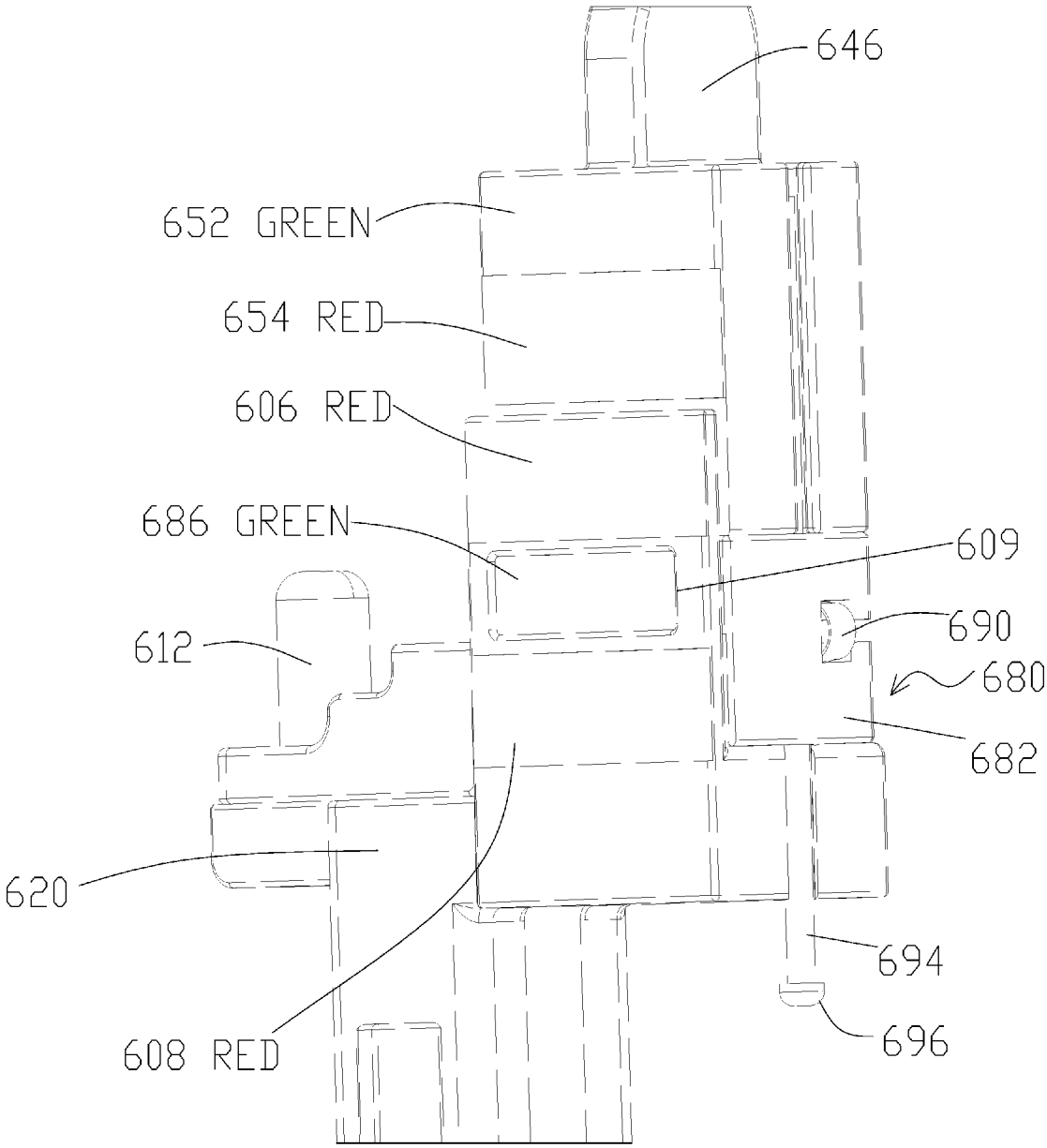
Figure 39:
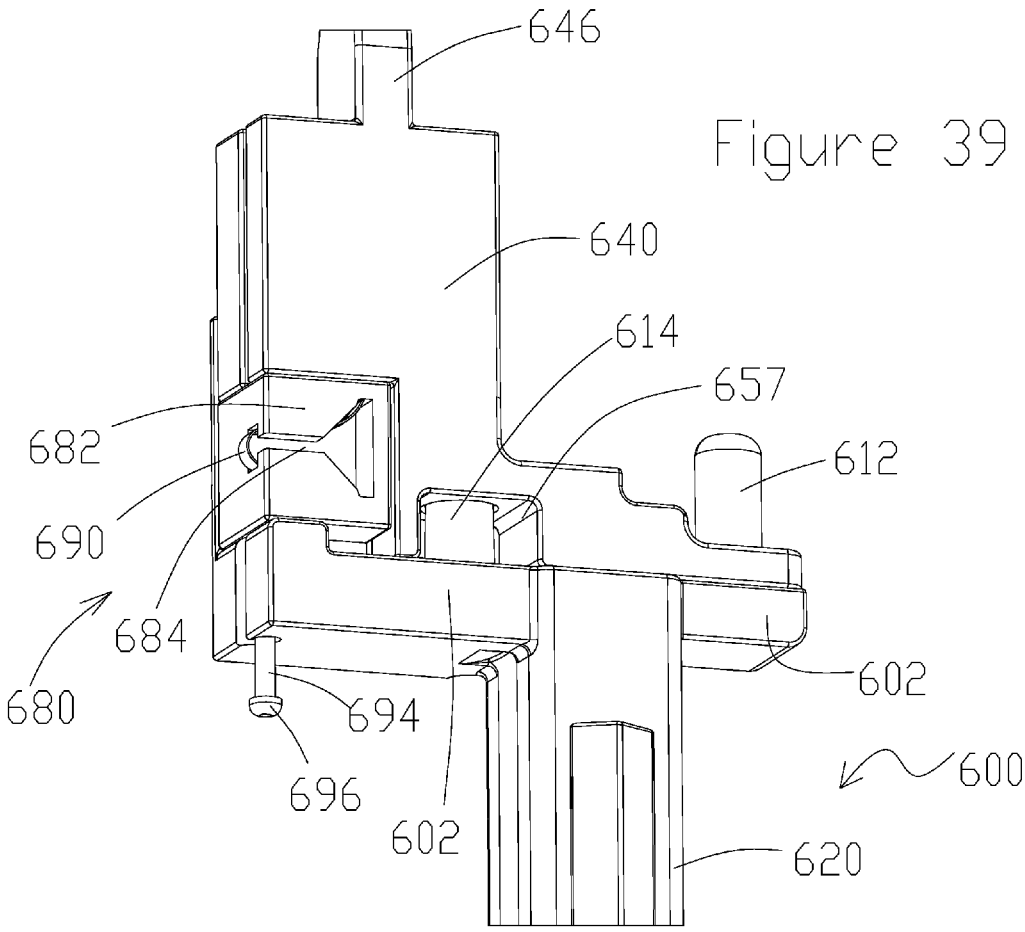

In addition to post portion 620, push pole 600 can include an auto cap indicator portion 604 having a first colored area 606, a second colored area 608 and an opening 609 between the two colored areas. Preferably, first colored area 606 and second colored area 608 are the same color (i.e. red), though such is not considered limiting, and preferably both colored areas represent the same information, namely, that there is something wrong with the auto cap 400 or that it is missing. When push pole 600 is move upward upon water activation through contact with contact portion 448, second colored area (i.e. red) is positioned/aligned with window 27 of housing 20 to indicate that the auto cap has been used. FIGS. 35*a* though 35*c* illustrate "red" showing in both window 25 and 27, indicating that both the cylinder and auto cap need to be attended to before auto inflator 10 will be in condition for use.

The above described actions constitute a non-limiting preferred water activated auto inflation method for inflator 10. Though not considered limiting, pill 460 portion of the auto inflation assembly 400 can be a paper or chemical or like component which can absorb an amount of water before dissolving to a point that it releases the torque of the spring thereby piercing the seal of gas cylinder 300. Though not considered limiting, pill 460 can also be of a cellulose material or composition.

Indication area 604 of push pole 604 extends more in front as compared to a remaining portion of a resting area 602, such that a space to the left of indication area 604 is created to permit portion 66 of contact arm 62 to move for contacting or otherwise moving cylinder indicator 640 during manual activation, while at the same avoiding contact or moving push pole 604, such that in a manual activation event, push pole remains in basically the same position as it is in prior to water activation.

Figure 31A:
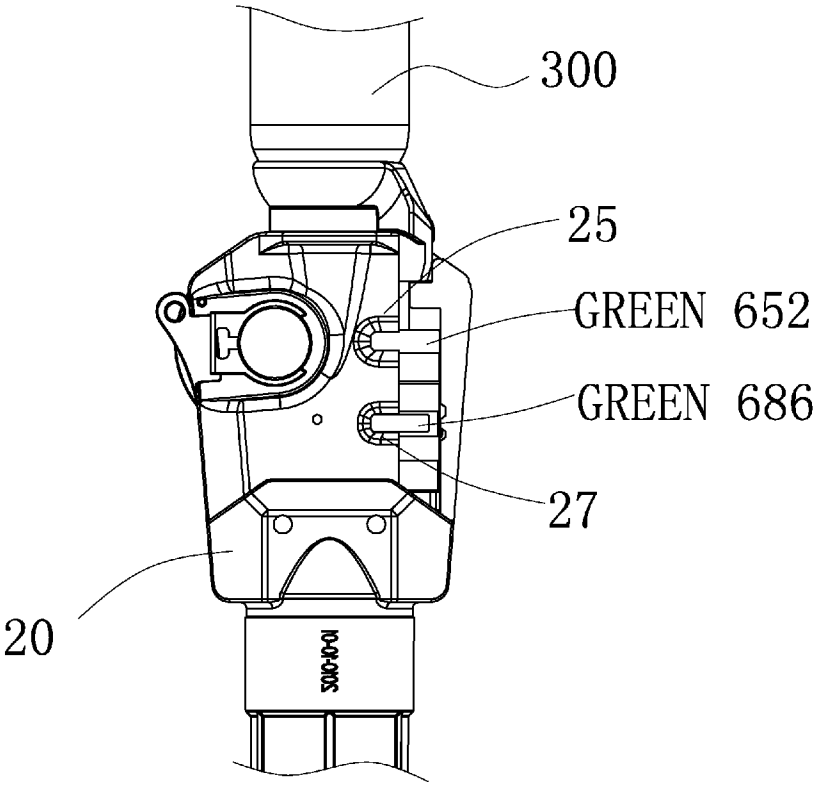
FIGS. 31*a* and 31*b* illustrate the inflator indicating that the both the cylinder and the auto cap are ready for use.
Figure 31B:
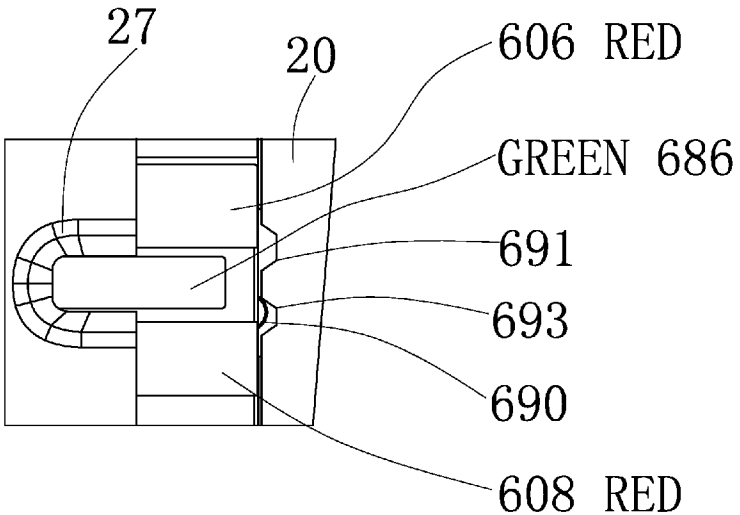
Figure 32B:
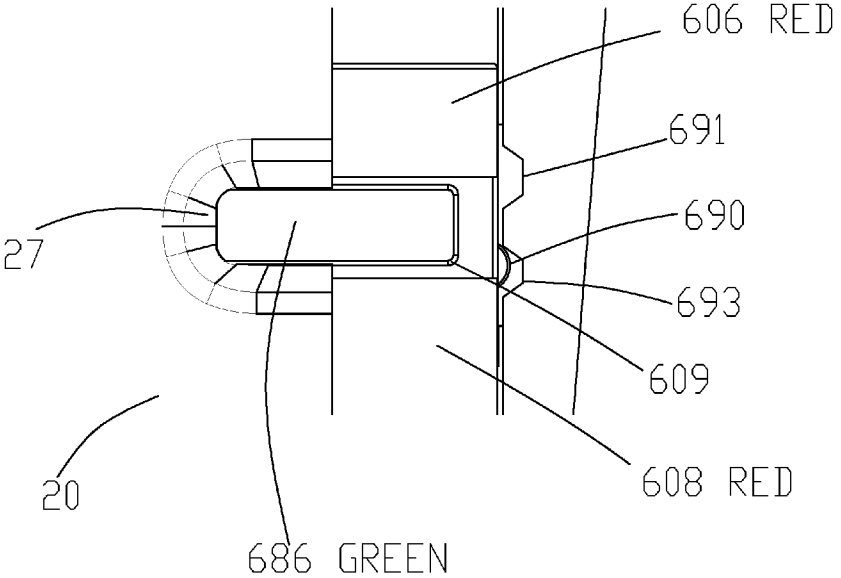
FIGS. 32*a* and 32*b* illustrate the inflator indicating that the cylinder is not ready for use but that the auto cap is ready for use.
Figure 32A:
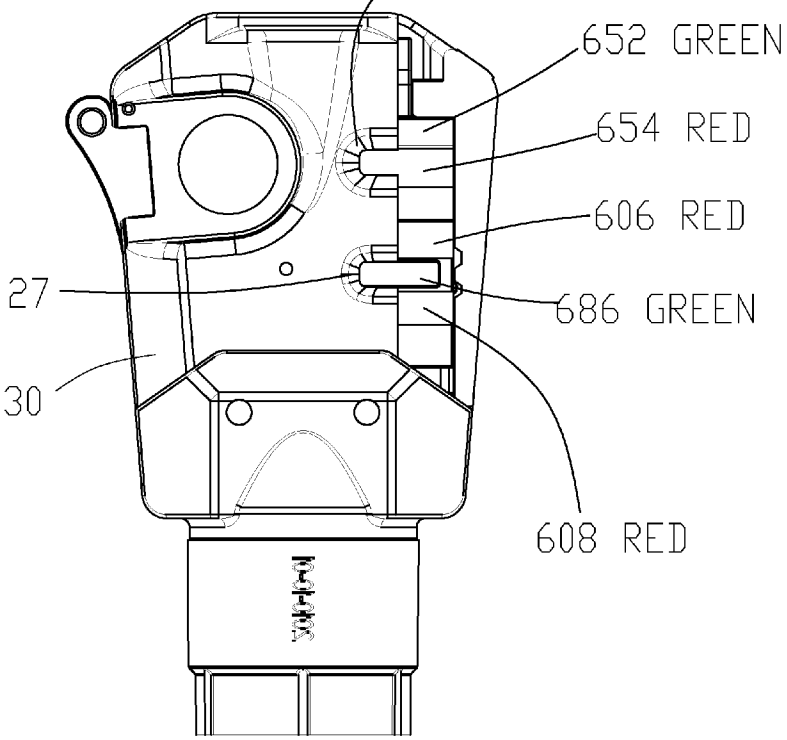
Figure 33B:
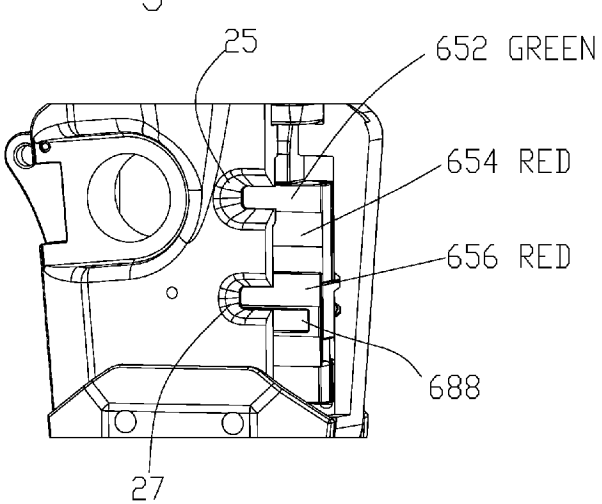
FIGS. 33*a* through 33*c* illustrate the inflator indicating that the auto cap is not ready for use but that the cylinder is ready for use.
Figure 33C:
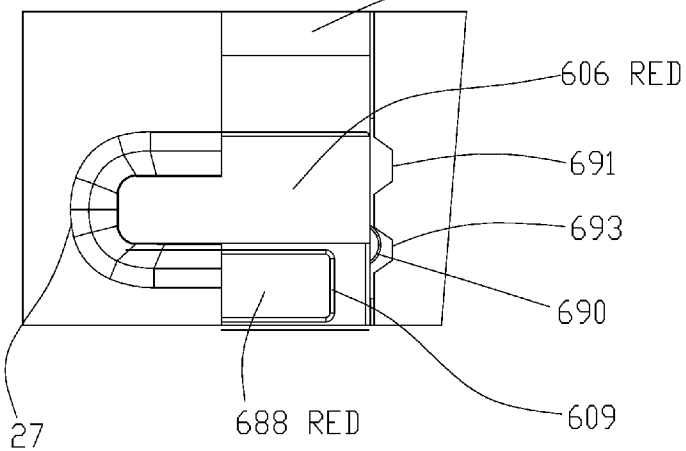
Figure 33A:
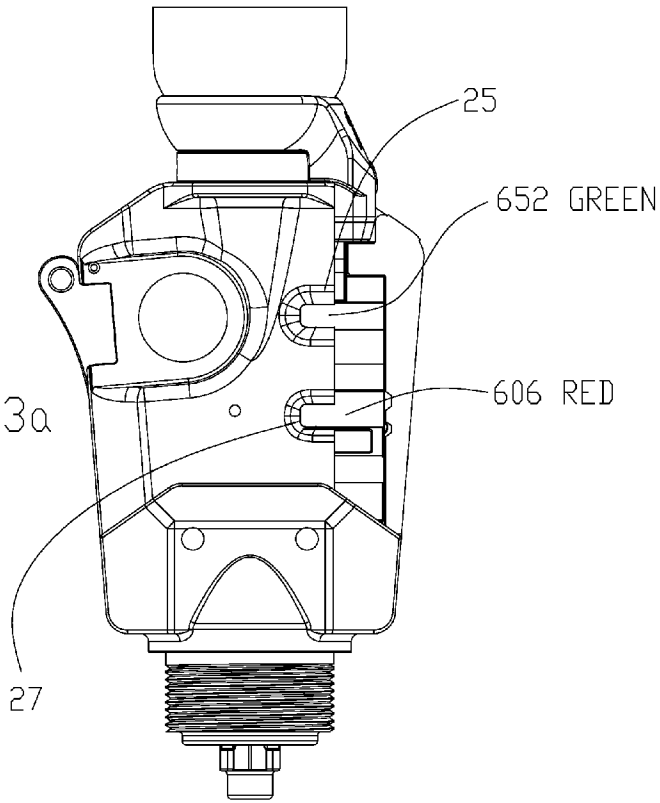

As seen in FIGS. 31*a* and 31*b*, prior to activation, when both cylinder 300 and auto cap 400 are ready for use, a green or other OK indication will be present in windows 25 (surface 652) and 27 (surface 686 of auto cap indicator 680). Auto cap indicator 680 includes a body 682 having a first surface 686 (OK status) and a second surface 688 (auto cap still OK but attention to inflator 10 otherwise needed). A cutout or other opening 684 is provided for receipt and securement of a spring board, spring leaf, etc. 690 which mates with one of two internal cutouts 691 or 693 in housing 20 to maintain the position of indicator 680 with respect to housing 20 unless sufficient force is provided to move spring board 690 out of opening 691 or 693. A moving pin or post 694 is secured to indicator body 682 which is also connected or otherwise associated with cylinder indicator 640 via opening 659, such that upward movement of cylinder indicator 640 also pulls auto cap indicator upward. Post 694 can also be slidably received by push pole 600 via a slot 617, such that movement of cylinder indicator 640 and/or auto cap indicator 680 does not cause push pole 600 to also move. Preferably, only contact by contact portion 448 with post portion 620 during water activation (auto activation) causes push pole to move upward within housing 620.

When both the cylinder 300 and auto cap 400 are ready for use opening 609 of push pole is aligned with window 27 and green or other OK indicating surface 686 is aligned with opening 609 and thus viewable through window 27 to indicate that the auto cap is ready for use (with surface 652 viewable through window 25 indicating that the cylinder is ready for use) (FIGS. 31*a* and 31*b*).

Figures 34A, 34B, 34C:
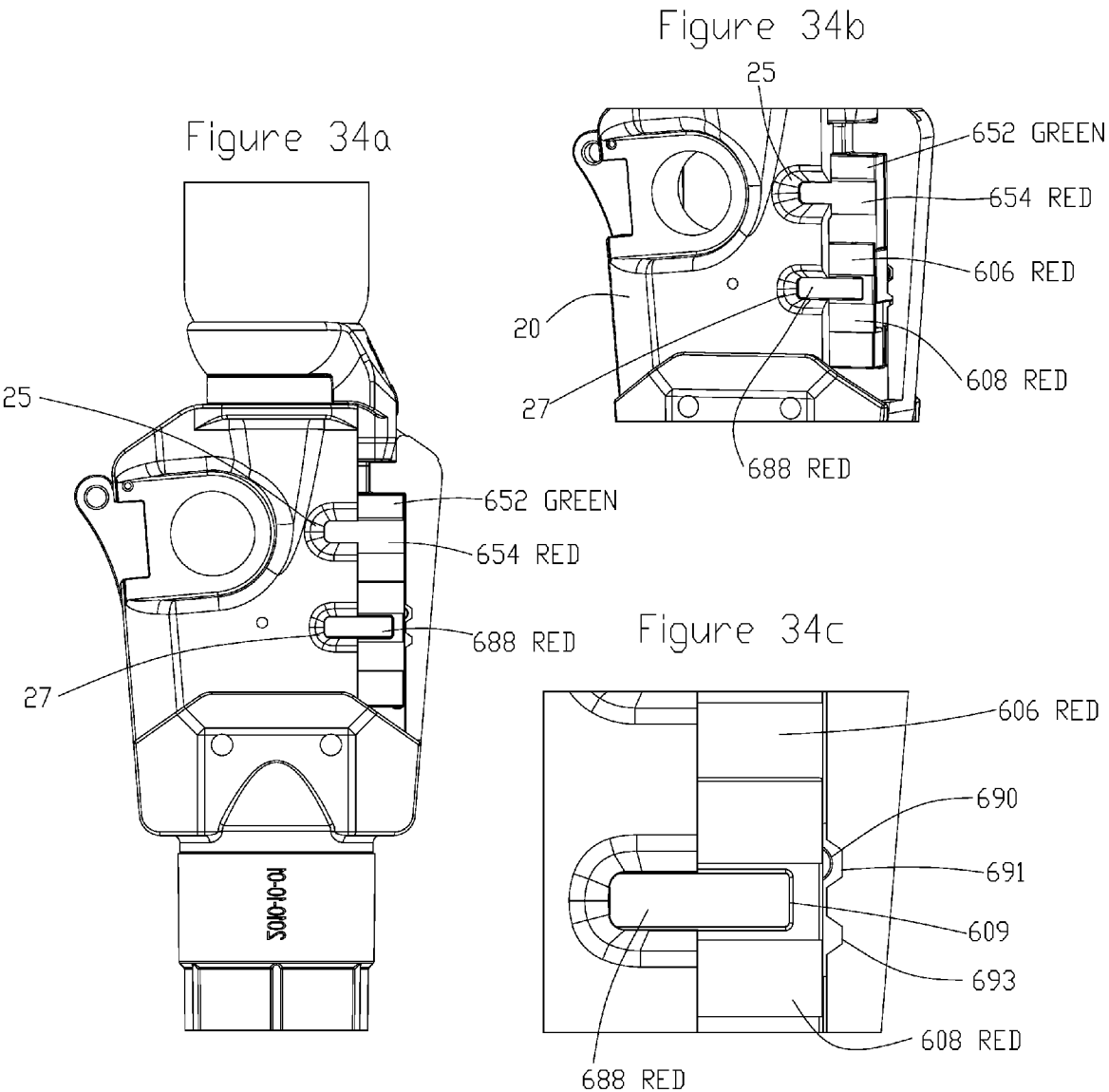
FIGS. 34*a* through 34*c* illustrate the inflator indicating that the cylinder has been discharged and as a cautionary measure shows a red in the auto cap indication window though the auto assembly is ready for use.

For manual inflation/activation of inflator 10 manual activation assembly 60 is operated by the user. When it is desired to manually inflate the inflatable item associated with manifold 220, the use jerks or pulls lanyard handle 80 which causes lanyard arm 62 via lanyard 64 to rotate around the first bolt such that end 66 contacts or otherwise move cylinder indicator 640 (and also auto cap indicator in view of post 694). The force of this contact causes breaking post 646 to move forward and break or snap protrusion 106 of sensor 100 and at the same time also moves pierce pin 190 forward to pierce the diaphragm seal and allow the gas to escape from cylinder or cartridge 300. In either auto activation or manual activation, the escaped gas enters body passageway 34 and into manifold opening 230 and ultimately inflates the intended item associated with manifold 220. Through the expansion of a spring disposed within opening 657 and around post 610 of push pole 600, red surface 654 is maintained in an aligned position with and viewable through body window 25 to indicate that cartridge 300 has been used and is no longer available for inflation purposes. The upward movement of cylinder indicator 640 also moves auto cap indicator which causes red surface 688 to present in window 27 (via opening 609 in indication area 604 of push pole 600) (See FIGS. 34*a* through 34*c*). This alerts the user to check the inflator 10 even though auto cap 400 has not been used.

After manual or automatic activation of inflator 10, CO2 sensor 100, nut 114, screw 118 and spent cartridge 300 can be removed from their secured attachment to body 20 by unmating threads 302 with threads 35 of body passageway 34 to release the connection. A new CO2 sensor 100 having an unbroken internal protrusion 106, along with attached new attached nut 114, a new screw 118 and new sealed cartridge 300 (collectively referred to as a "reaming kit" or "rearming assembly") can then be secured to body 20 as described above. As protrusion 106 for new CO2 sensor 100 is unbroken, breaking post 646 abuts protrusion 106 and cylinder 640 is positioned such that "green" status surface 652 appears in window 25 to indicate that CO2 cartridge 300 is full and ready for use.

As seen in FIGS. 8*a* through 8*c*, cylinder indicator 460 can also include a first push pole post receiving aperture 655 for receipt of post 612 of push pole 600, a pierce pin receiving aperture 653 and a cutout 657 for receipt a middle post 614 of push pole 600 and spring which will be disposed around post 614. As seen in FIGS. 9*a* and 9*b*, pierce pin 190 include a first end opposite the piercing end which is received within pierce pin aperture 653 of cylinder indicator 460 and an opposite sharp or pointed end 194 which serves to pierce the cartridge seal (i.e. diaphragm) of CO2 cartridge 300 when it is desired to inflate the article to which manifold 220 is associated with (i.e. life raft, life vest, life jacket, tube, etc.).

A spring and washer can also be provided at pointed end 194. The pierce pin spring helps to keep pierce pin 190 flush with the bottom of the threads and pushes the needle back down when the rearming assembly is reset or secured in place. The washer aids in attaching CO2 cylinder 300 during screwing in. The operator can feel the resistance telling him or her that CO2 cylinder 300 is nearly torqued sufficiently. The washer also helps in providing for a good seal during the CO2 flow out of cylinder 300 once pierce pin penetrates or breaks the cylinder seal. Pierce pin 190 also comprises a lower half rod, which helps to keep pierce pin 190 and cylinder indicator 460 function separately. An o-ring can also be provided preferably in the middle of pierce pin and acts as seal to keep the CO2 flow where it needs to go, namely, thru manifold 220 and ultimately within the inflatable chamber associated with manifold 220.

As best seen in FIGS. 4*a*, 4*b*. 37, 38 and 39 push pole 600 can be provided with a first post 612 which is received within cylinder indicator aperture 655 and a second middle or intermediate post 614 which is received within cylinder indicator cutout 657 along with a spring and within aperture 651 of cylinder aperture which is in communication with cutout 657. Prior to detonation of cylinder 300 through inflator 10, the spring around post 614 and within cutout 657 is preferably in a compressed configuration. The breaking of protrusion 106 by post 466 causes the spring in cutout to expand to help maintain cylinder indicator in position such that it shows a RED status in window 25.

In addition to contact arm 62, activating assembly 60 can comprise a lanyard, rope, strap, line, cord, etc. (collectively referred to as lanyard) having a copper or other metal tube/shrink tube and a lanyard tab or handle 80. The lanyard can have a first end which is connected to contact arm 62 and a second end which is connected to lanyard tab 80. The copper or other metal tube acts as a crimp to hold the lanyard together for strength. The shrink tube helps to keep the lanyard tucked in and help to prevent it from rubbing against a chamber or bladder of air. Lanyard tab 80 can include indicia on either one or both surfaces. In one embodiment, the indicia can be operating instructions, or a message such as, but not limited to, "JERK TO INFLATE", etc.

To assemble manual inflator 10, push pole 600, auto cap indicator 680 and cylinder indicator 460 are properly connected or associated with each other and pierce pin 190 is properly connected to or associated with cylinder indicator 460. Any associated spring(s), washer(s) and o-ring(s) are also properly positioned. These connected components are internally disposed within housing 20 and/or base 500. CO2 sensor 100 with cartridge 300, screw 118 and nut 114 connected thereto is attached to body 20 through the mating of threads 302 with internal threads 35 of body passageway 34. As mentioned above, when properly connected breaking post 466 abuts internal protrusion 106 of sensor 100 which positions or aligns green surface area 452 with body window 25 so that it is viewable to indicate that cartridge 300 is full (operable) and ready for use. The abutting position of post 466 with protrusion 106 also positions piercing end 194 at the sealed end of cartridge or abutting the seal, which can be a diaphragm or other type of device used to seal cartridge 300 prior to use. Activating assembly 60 can be preferably secured to body 20 at the same time that base 500 is secured through the same first bolt being inserted through the aligned openings/apertures. Auto cap 400 is then secured to base 500 which causes opening 609 in push pole to aligned with window 27 and green surface 686 of auto cap indicator 680 to be viewed through window 27 and opening 609 indicating that auto cap 400 is ready for use. In this configuration spring leaf 690 preferably resides within internal housing cutout 693 to help maintain auto cap indicator 680 in a fixed position.

As described above CO2 sensor 100 can be separate from pierce pin 190. By pulling lanyard tab 80 or through water activation, pierce pin 190 and cylinder indicator 460 are moved towards CO2 cylinder 300. While pierce pin 190 penetrates or breaks the seal for CO2 cylinder 300, at the same time post 466 of cylinder indicator 460 breaks sensor clip or protrusion 106 inside the arm of sensor body 102. Once CO2 sensor clip 106 is broken, window 25 displays red surface 454 of indicator 460 to indicate that CO2 cylinder 300 is spent and needs replacement. Spring 180 disposed within cutout 459 pushes cylinder indicator 460 up and maintains the position of cylinder indicator 460 so that window 25 displays red surface 454 once sensor clip or protrusion 106 is broken or when no rearming kit is secured to body 20 (i.e. cylinder 300 is missing, etc.). Since clip or protrusion 106 is broken, the post 466 does not have anything pushing it down to align green surface 452 with window 25 and thus red surface 454 is shown in window 25 instead.

Prior to rearming, pierce pin 190 can be flush or substantially flush with the top of the inflator body opening 34. Securing a new rearming kit to body member 20 pushes pierce pin 190 (via clip 106 and post 466) back to its internal position with respect to body 20 where it is ready for piercing the seal of new cartridge 300 when needed (i.e. normal rearming position). A good CO2 sensor 100, will have an unbroken clip or protrusion 106 and thus will push cylinder indicator 460 down, such that green surface 452 is displayed in window 25, to indicate that inflator 10 is rearmed.

The construction of inflator 10 also permits a user, such as in an emergency situation, to screw in a conventional CO2 cartridge without a sensor 100. In this situation, red surface 454 (status indication) will be displayed in window 25 since there is no clip or protrusion 106 abutting post 466. However, the wearer or user knows that the CO2 cartridge is good and inflator 10 can still be used. In these situations, the user again pulls lanyard tab 80 to move lanyard arm 62 to inflate a personal flotation device ("PFD") or other desired inflatable item similar to as described above or the inflator can be automatically activated through auto cap 400.

Though the primary use of inflator 10 will be with a cartridge or cylinder 300 containing CO2, it is within the scope of the invention to store or house other gases within cartridge/cylinder 300 and inflator can be used for these gases or combination of gases as well similar to as described above for a cartridge/cylinder 300 storing CO2. It should also be recognized that certain of the components for inflator 10 described separately above can be combined as a one piece integral or monolithically formed component. As a non-limiting example, pierce pin 190 and cylindrical indicator 460 can be provided as a one piece member.

Various o-rings, washer and springs can be provided for their conventional purposes. Activation assembly 60 can comprise a conventional lanyard with a pull tab/handle and shrink tube and/or copper tube.

Thus, the inflator is provided with two windows for indicating status. The top window is used for indicating the status of the cylinder and the bottom window is used for indicating the status of the auto cap. Preferably, two different colors are used with the first color selected to represent an "OK" status and the second color selected to represent a "Problem" status. In a preferred embodiment, the first color can be green and the second color can be red, though such is not considered limiting and other colors can be selected and used and are also considered within the scope of the invention. Having upper and lower indicators, a safety factor is provided that informs the user exactly where the problem is; unlike a 1 f inflator which only has 1 indicator and the user must still trace the problem or red indication.

The lower mechanism or window preferably turns red even with manual actuation only. Then the indicator is reset to a green indication by resetting the pull lanyard or taking off and putting back on the non-discharged auto cap.

When all components are properly secured and working, the various components maintain the indicating members in position such that both windows show green (or other designated color to indicate everything is working). If the gas cylinder is removed, used or destroyed its secured blocking member, no longer is available to maintain the position of the cylinder indicator causing it to move upwards (in view of springs within the inflator), which in turns causes the top or upper window to show red (or other designated color to indicate something is wrong with the cylinder). Similarly, if the auto cap is removed, used or destroyed the lower portion of the push pole is moved downward, such that the top red outer surface portions of the lower push pole portion appears in the lower window.

After manual operation only, as it is preferred to also show red for the auto cap, the movement of indicator for the cylinder moves upward allowing the red portion to appear in the top or upper window. Through a securement pole 694 the movement upward by the cylinder indicator pulls the auto cap indicator upward which positions the red surface of the indicator to be disposed within a window/aperture 609 in the push pole 600 which is aligned with the lower window in the inflator body. Thus, a red signal from the red surface of the auto cap indicator is shown in lower inflator window. When the cylinder and auto cap are properly secured and working, the movement downward of the cylinder indicator causes the green surface of the auto cap indicator to be positioned within the window/aperture of the lower push pole portion, and thus, viewable through the lower inflator window.

Applicant also incorporates by reference in its entirety his U.S. Pat. No. 7,854,347 (U.S. application Ser. No. 11/421,997) entitled Manual Gas Inflator, as if fully set forth herein, for operation and assembly of any similar inflator components found in the instant invention.

A "ready to use" status can be a green surface area, or other chosen surface color area, or other wording or indicia. Similarly, a "problem" status can be a red surface area, or other chosen surface color area, or other wording or indicia. The use of term "window" does not require a glass or plastic portion, etc. as part of window 25 and/or window 27, which can merely be ordinary openings, slots or apertures.

It is also within the scope of the invention to have the base and housing one piece.

All locations, sizes, shapes, configurations, measurements, amounts, weights, dimensions, values, percentages, materials, orientations, etc. discussed above or shown in the drawing figures are merely by way of example and are not considered limiting and other locations, sizes, shapes, configurations, measurements, amounts, weights, dimensions, values, percentages, materials, orientations etc. can be chosen and used and all are considered within the scope of the invention.

Unless feature(s), part(s), component(s) or characteristic (s) described in the specification or shown in the drawings for a claim element or claim term specifically appear in the claim with the claim element or claim term, then the inventor does not considered such feature(s), part(s), component(s) or characteristic(s) to be included for the claim element or claim term in the claim when and if the claim element or claim term is interpreted or construed. Similarly, with respect to any "means for" elements in the claims, the inventor considers such language to require only the minimal amount of features, components, steps or parts from the specification to achieve the function of the "means for" language and not all of the features, components, steps or parts describe in the specification that are related to the function of the "means for" language.

While the invention has been described and disclosed in certain terms and has disclosed certain embodiments or modifications, person skilled in the art who have acquainted themselves with the invention, will appreciate that it is not necessarily limited by such terms, nor to the specific embodiments and modifications disclosed herein. Thus, a wide variety of alternatives, suggested by the teachings herein, can be practiced without departing from the spirit of the invention, and rights to such alternatives are particularly reserved and considered within the scope of the invention.

What is claimed is:

1. A gas inflator capable of both automatic activation and manual activation, comprising:

a housing having a front surface and a back surface, the front surface defining a first window and a second window and having a housing opening extending from said front surface to said back surface;

a manual activation assembly movably secured to said housing, said manual activation assembly having a contact arm, a lanyard and a handle, said lanyard secured at a first end to said contact arm and at a second end to said handle;

an automatic activation assembly secured to said housing, said automatic activation assembly having a dissolvable member and a contact member;

an cylinder indicator internally disposed within said housing, said indicator having a front surface, said indicator front surface having a first area indicating "ready to use" and a second color area indicating "problem", said cylinder indicator having a post member, said first area indicating a full gas cylinder is properly attached to said housing and said second area indicating that a detonated or empty gas cylinder is attached to said housing or that a cylinder is not attached;

a push pole having a first post member and having a third area indicating a "problem", a fourth color area indicating a "problem" and an opening disposed between the third area and the fourth area;

an automatic activation assembly indicator having a fifth area indicating "ready to use" and a sixth area indicating a "problem" and movable with the movement of said cylinder indicator;

a piercing assembly having a piercing end, said piercing assembly movable with the movement of said cylinder indicator; and a gas sensor having a body with an extended arm, said arm defining an internal area and having a protrusion extending within the internal area; said gas sensor adapted for attachment to a gas cylinder, the gas cylinder having a threaded end which is sealed prior to detonation;

wherein prior to detonation of an attached gas cylinder, said post member of said cylinder indicator contacts said protrusion of said gas sensor assembly such that said first area of said cylinder indicator is viewable through the first window of said housing and said fifth area of said auto activation indicator is viewable through said opening of said push pole and through said second window; wherein upon detonation of an attached gas cylinder said post member breaks said protrusion such that said second area of said cylinder indicator is viewable through the window.

2. The manual gas inflator of claim 1 wherein when activation is automatic, the contact member contacts the post of said push pole which moves the push pole upwards causing the fourth area to be viewable within the second window.

3. The manual gas inflator of claim 1 wherein during automatic activation the dissolvable member is dissolved which causes the release of the contact member such that it contacts the post of said push pole.

4. The manual gas inflator of claim 1 further comprising a base secured to a bottom portion of said inflator housing, a portion of the post of said push pole extending out of a lower end of said base is secured to said housing prior to automatic activation.

5. The manual gas inflator of claim 4 wherein said automatic activation assembly is secured to said base.

6. The manual gas inflator of claim 1 wherein said dissolvable member is a fluid dissolvable pill that dissolves upon contact with water.

7. A method of indicating the status of gas cylinder and separately indicating the status of automatic activation components for a gas inflator, said gas inflator having a housing, wherein said method comprising the steps of:

(a) providing a first "ready to use" status through a first window of an gas inflator housing when a sealed gas cylinder is properly secured to the inflator housing; and (b) providing a second "ready to use" status through a second window of the gas inflator housing when an unactivated auto cap is properly secured to the inflator housing.

8. The method of claim 7 further comprising the step of replacing the first "ready to use" status with a "problem" status in the first window after a seal for the gas cylinder has been pierced or opened.

9. The method of claim 7 further comprising the step of replacing the first "ready to use" status with a "problem" status in the first window after a seal for the gas cylinder has been pierced or opened and replacing the second "ready to use status with a "problem" status in the second window after the auto cap has been activated.

* * * * *